US010312583B2

(12) United States Patent
Ng et al.

(10) Patent No.: US 10,312,583 B2
(45) Date of Patent: Jun. 4, 2019

(54) ANTENNA SYSTEMS WITH LOW PASSIVE INTERMODULATION (PIM)

(71) Applicant: Laird Technologies, Inc., Earth City, MO (US)

(72) Inventors: Kok Jiunn Ng, Perak (MY); Joshua Ooi Tze-Meng, Selangor Darul Ehsan (MY); Wei Tat Ng, Kedah (MY)

(73) Assignee: LAIRD TECHNOLOGIES, INC., Chesterfield, MO (US)

( * ) Notice: Subject to any disclaimer, the term of this patent is extended or adjusted under 35 U.S.C. 154(b) by 223 days.

(21) Appl. No.: 15/013,071

(22) Filed: Feb. 2, 2016

(65) Prior Publication Data

US 2016/0172750 A1 Jun. 16, 2016

Related U.S. Application Data

(63) Continuation of application No. PCT/US2014/050301, filed on Aug. 8, 2014.

(51) Int. Cl.
*H01Q 1/52* (2006.01)
*H01Q 1/48* (2006.01)
(Continued)

(52) U.S. Cl.
CPC ..... *H01Q 1/521* (2013.01); *H01Q 1/42* (2013.01); *H01Q 1/48* (2013.01); *H01Q 1/526* (2013.01);
(Continued)

(58) Field of Classification Search
CPC ..... H01Q 1/521; H01Q 21/28; H01Q 9/0421; H01Q 9/0414; H01Q 1/42; H01Q 1/48; H01Q 1/526
See application file for complete search history.

(56) References Cited

U.S. PATENT DOCUMENTS 6,414,636 B1 7/2002 Godard et al.
9,153,873 B2 10/2015 Ng et al.
(Continued)

FOREIGN PATENT DOCUMENTS

CN 1390374 A 1/2003
CN 102738570 A 10/2012
(Continued)

OTHER PUBLICATIONS

International Search Report and Written Opinion dated Nov. 19, 2014 for PCT application No. PCT/US2014/050301 filed Aug. 8, 2014 (published as WO 2015/041768 on Mar. 26, 2015) which is the parent application to the instant application; 11 pages.
(Continued)

*Primary Examiner* — Hai V Tran
*Assistant Examiner* — Michael M Bouizza
(74) *Attorney, Agent, or Firm* — Harness, Dickey & Pierce, P.L.C.; Anthony G. Fussner

(57) ABSTRACT

According to various aspects, exemplary embodiments are disclosed of antenna systems. In an exemplary embodiment, an antenna system generally includes a ground plane and first and second antennas. A first isolator is disposed between the first and antennas. A second isolator extends outwardly from the ground plane. The antenna system is configured to be operable with low passive intermodulation.

20 Claims, 30 Drawing Sheets

(51) Int. Cl.

| | |
|---|---|
| ***H01Q 5/30*** | (2015.01) |
| ***H01Q 1/42*** | (2006.01) |
| ***H01Q 9/04*** | (2006.01) |
| ***H01Q 21/28*** | (2006.01) |

(52) U.S. Cl.
CPC ..... *H01Q 9/0414* (2013.01); *H01Q 9/0421* (2013.01); *H01Q 21/28* (2013.01)

(56) References Cited

U.S. PATENT DOCUMENTS

| | | | | |
|---|---|---|---|---|
| 2006/0202900 | A1 | 9/2006 | Simile | |
| 2009/0091507 | A1* | 4/2009 | Chung | H01Q 1/521 343/841 |
| 2009/0224995 | A1 | 9/2009 | Puente et al. | |
| 2010/0214190 | A1 | 8/2010 | Shin et al. | |
| 2011/0241965 | A1* | 10/2011 | Wu | H01Q 9/22 343/847 |
| 2012/0256794 | A1 | 10/2012 | Veihl et al. | |
| 2013/0099992 | A1 | 4/2013 | Wu | |
| 2013/0141307 | A1 | 6/2013 | Nurnberger et al. | |
| 2013/0229318 | A1 | 9/2013 | Ng et al. | |
| 2013/0285877 | A1* | 10/2013 | Desclos | H01Q 1/42 343/872 |

FOREIGN PATENT DOCUMENTS

| | | | |
|---|---|---|---|
| CN | 103004018 | A | 3/2013 |
| WO | WO-2012112022 | A1 | 8/2012 |
| WO | WO-2015041768 | A1 | 3/2015 |

OTHER PUBLICATIONS

Taiwan Office Action and its English translation from Taiwan Application No. 103131712 filed Sep. 15, 2014 which claims priority to the same parent application as the instant application; dated Feb. 26, 2016; 8 pages.

Chinese Office Action dated Dec. 6, 2016 for Chinese patent application No. 201410472083.4 which claims priority to the same parent application as the instant application, 8 pages.

* cited by examiner

ANTENNA SYSTEMS WITH LOW PASSIVE INTERMODULATION (PIM)

CROSS-REFERENCE TO RELATED APPLICATIONS

This application is a continuation of PCT International Application No. PCT/US2014/050301 filed Aug. 8, 2014 (published as WO 2015/041768 on Mar. 26, 2015) which, in turn, claims the benefit of and priority to Malaysian Application No. PI2013701673 filed Sep. 17, 2013. The entire disclosures of the above applications are incorporated herein by reference.

FIELD

The present disclosure generally relates to antenna systems with low or good PIM (passive intermodulation), and which may also have improved and/or good isolation and bandwidth.

BACKGROUND

This section provides background information related to the present disclosure which is not necessarily prior art.

Examples of infrastructure antenna systems include customer premises equipment (CPE), satellite navigation systems, alarm systems, terminal stations, central stations, and in-building antenna systems. With fast growing technologies, antenna bandwidth has become a great challenge along with the requirement to miniaturize CPE device size or antenna system size in order to maintain a low profile. In addition, multi-antenna systems having more than one antenna have been used to increase capacity, coverage, and cell throughput.

Also with fast growing technologies, many devices have gone to multiple antennas in order to satisfy the end customers' demand. For example, multiple antennas are used in multiple input multiple output (MIMO) applications in order to increase user capacity, coverage, and cell throughput. With the current market trend towards economical, small, and compact devices, it is not uncommon to use multiple antennas identical in form that are placed in very close proximity to each other due to size and space limitations. Moreover, antennas for customer premises equipment, terminal stations, central stations, or in-building antenna systems, must usually be low profile, light in weight, and compact in physical volume, which makes Planar Inverted F-Antennas (PIFAs) particularly attractive for these types of applications.

FIG. 1 illustrates a conventional Planar Inverted F-Antenna (PIFA) 10. As shown in FIG. 1, this basic design consists of a radiating patch element 12, a ground plane 14, a shorting element 16, and a feeding element 18. The width and length of the radiating patch element 12 determines the desired resonant frequency. The summation of the width and length of the radiating patch element 12 is about one quarter wavelength ($\lambda/4$). The radiating patch element 12 may be supported by a dielectric substrate above the ground plane 14.

SUMMARY

This section provides a general summary of the disclosure, and is not a comprehensive disclosure of its full scope or all of its features.

According to various aspects, exemplary embodiments are disclosed of antenna systems. In an exemplary embodiment, an antenna system generally includes a ground plane and first and second antennas. A first isolator is disposed between the first and second antennas. A second isolator extends outwardly from the ground plane. The antenna system is configured to be operable with low passive intermodulation.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 10A:
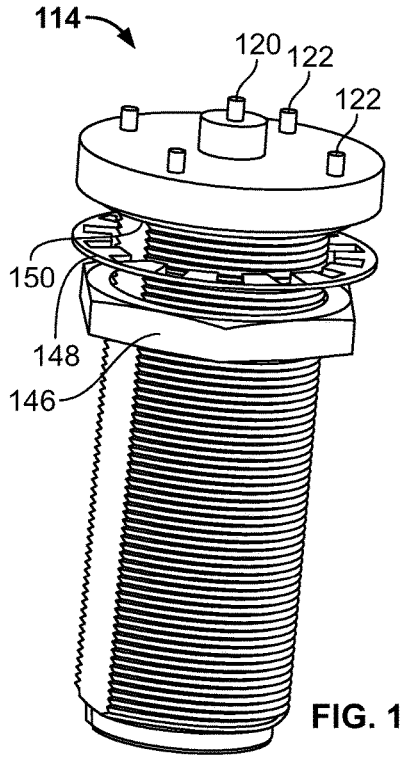
FIGS. 10A and 10B are respective perspective views of an exemplary NF bulkhead connector and exemplary insulator that may be used with the antenna system shown in FIGS. 2 through 5 where the insulator helps to minimize (or at least reduce) contact area to the ground plane and subsequently minimize (or at least reduce) PIM issues according to exemplary embodiments.
Figure 11:
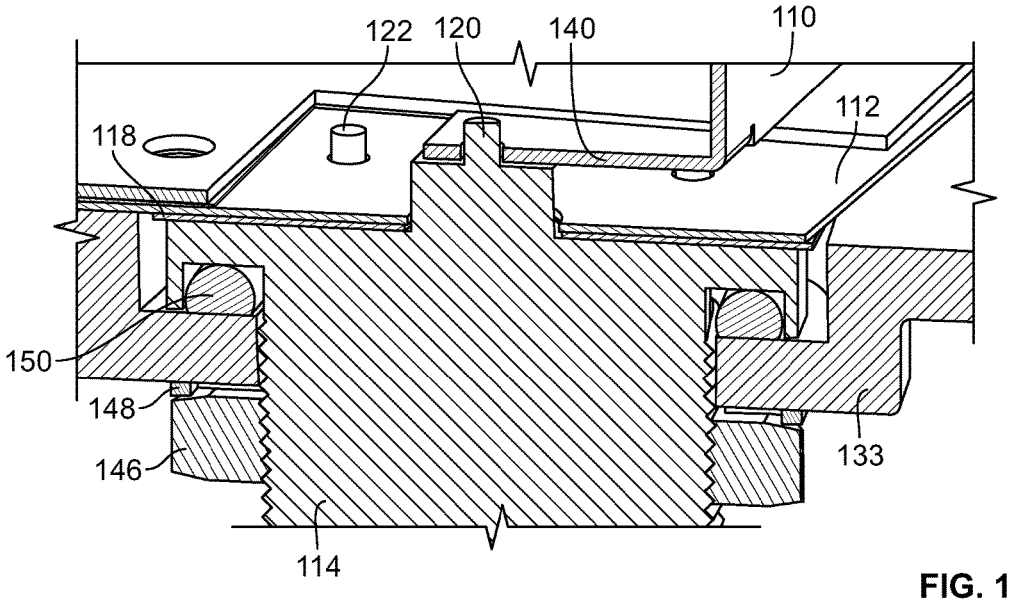
FIG. 11 is a cross-sectional view showing the exemplary way that the NF bulkhead connector and insulator shown in FIG. 10 may be connected to the ground plane and antenna of the antenna system shown in FIGS. 2 through 5.
Figure 12A:
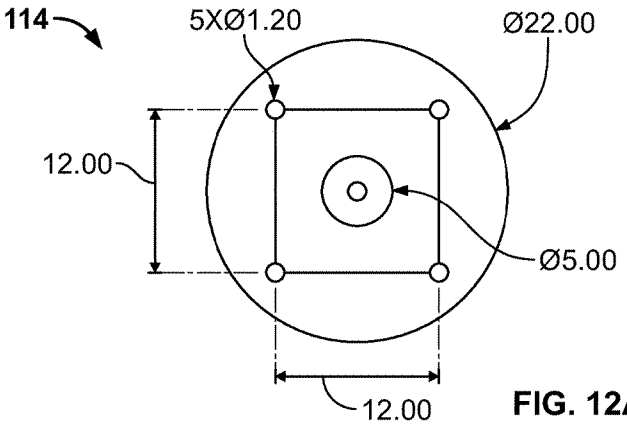
Figure 12C:
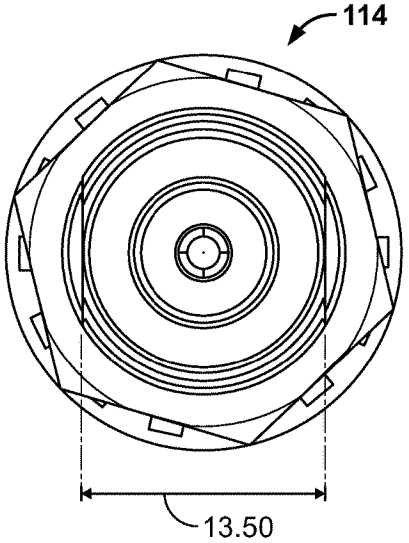
Figure 12B:
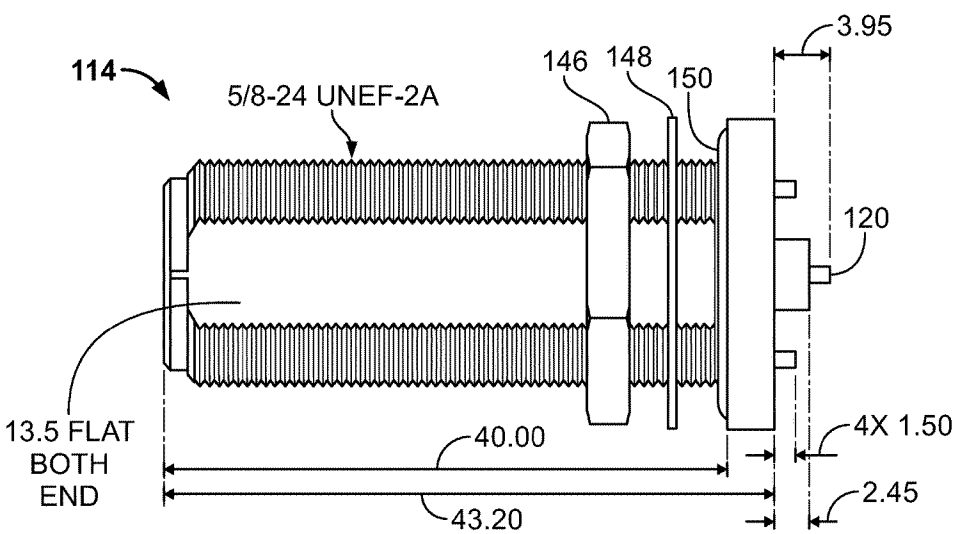
Figure 13:
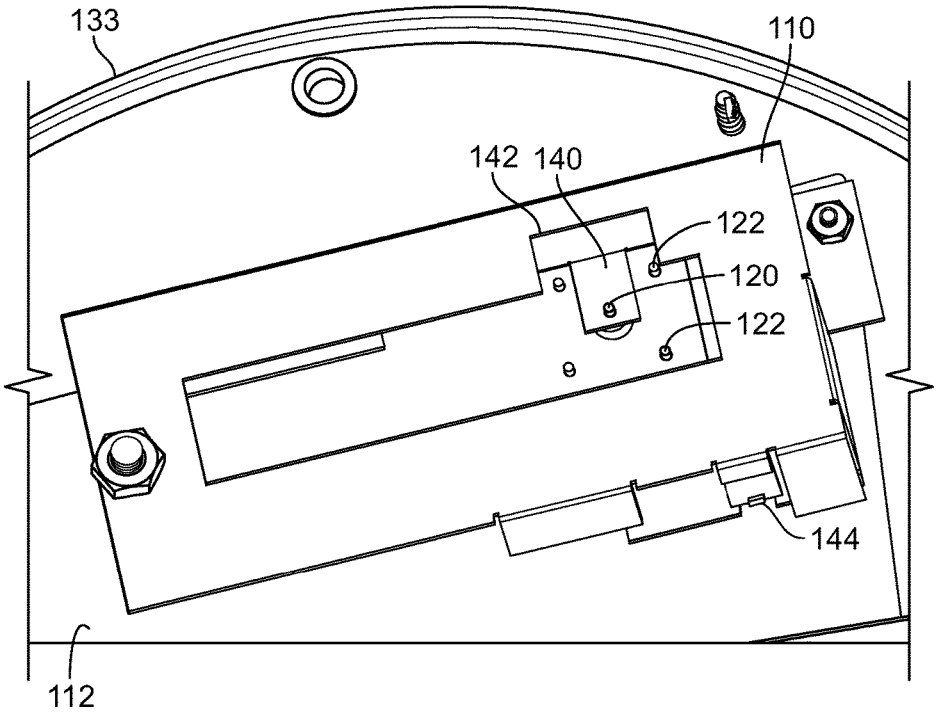
Figure 14:
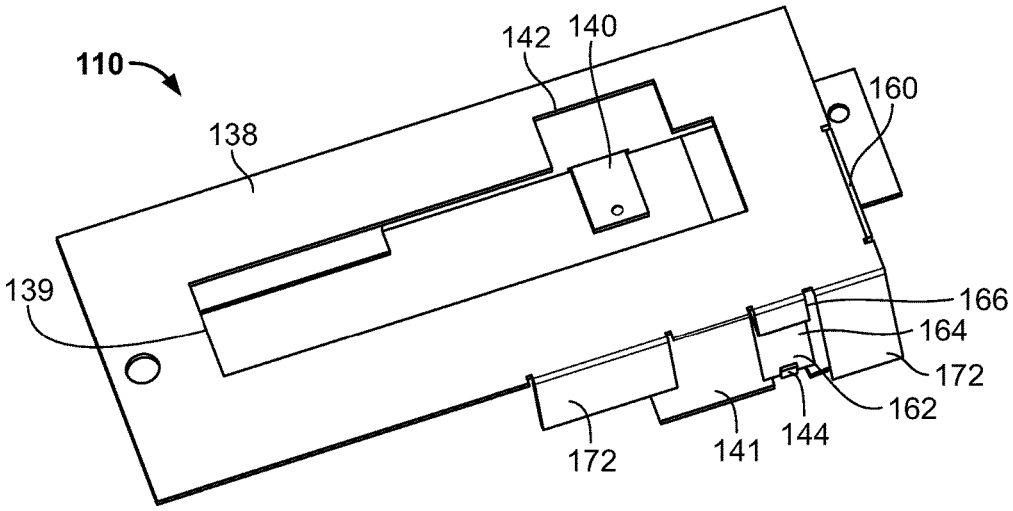
Figure 15A:
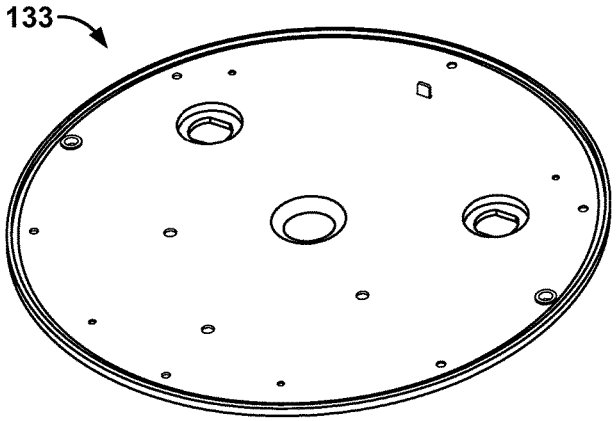
Figure 15B:
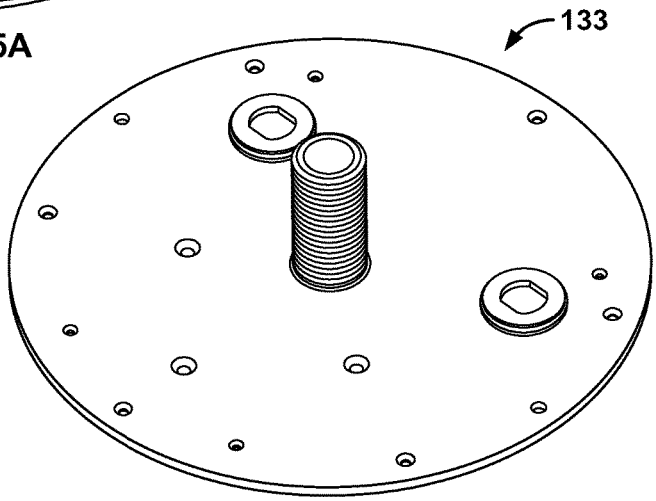
Figure 15C:
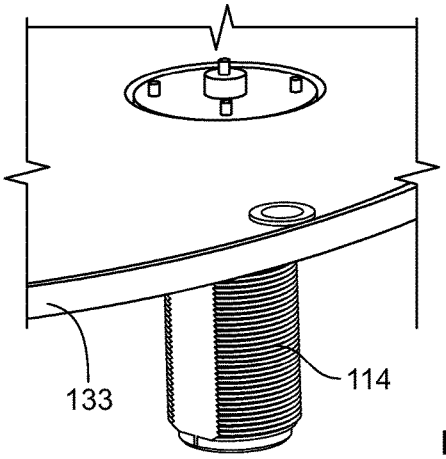
Figure 16A:
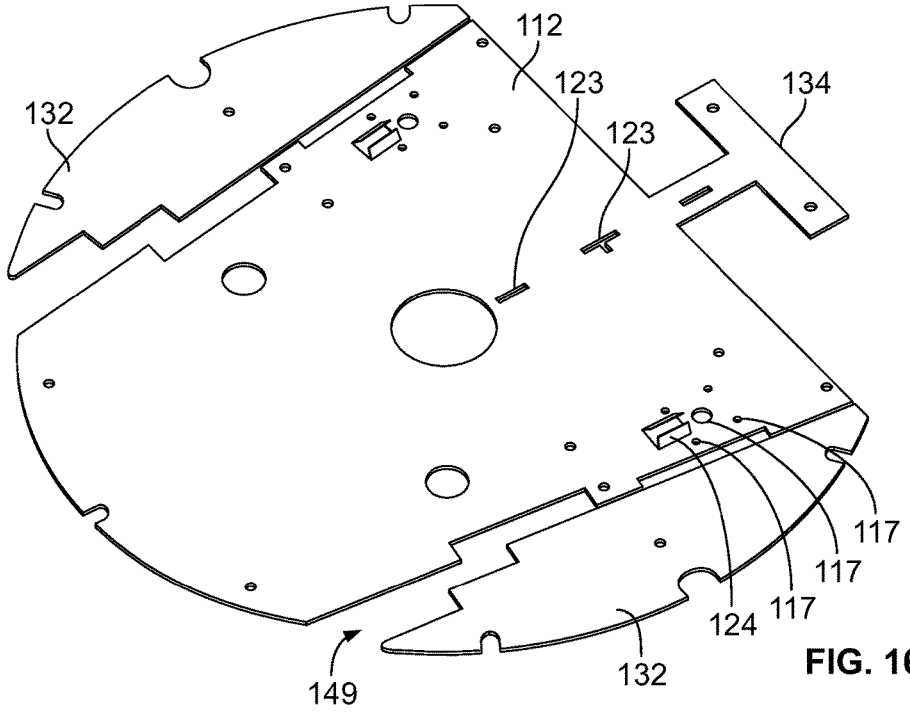
Figure 16B:
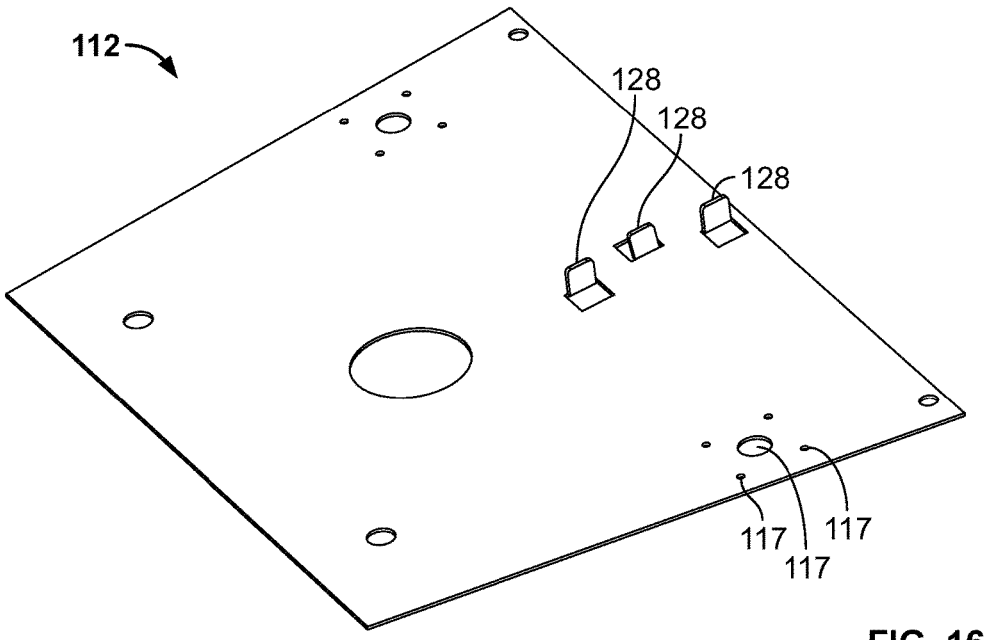
Figure 17A:
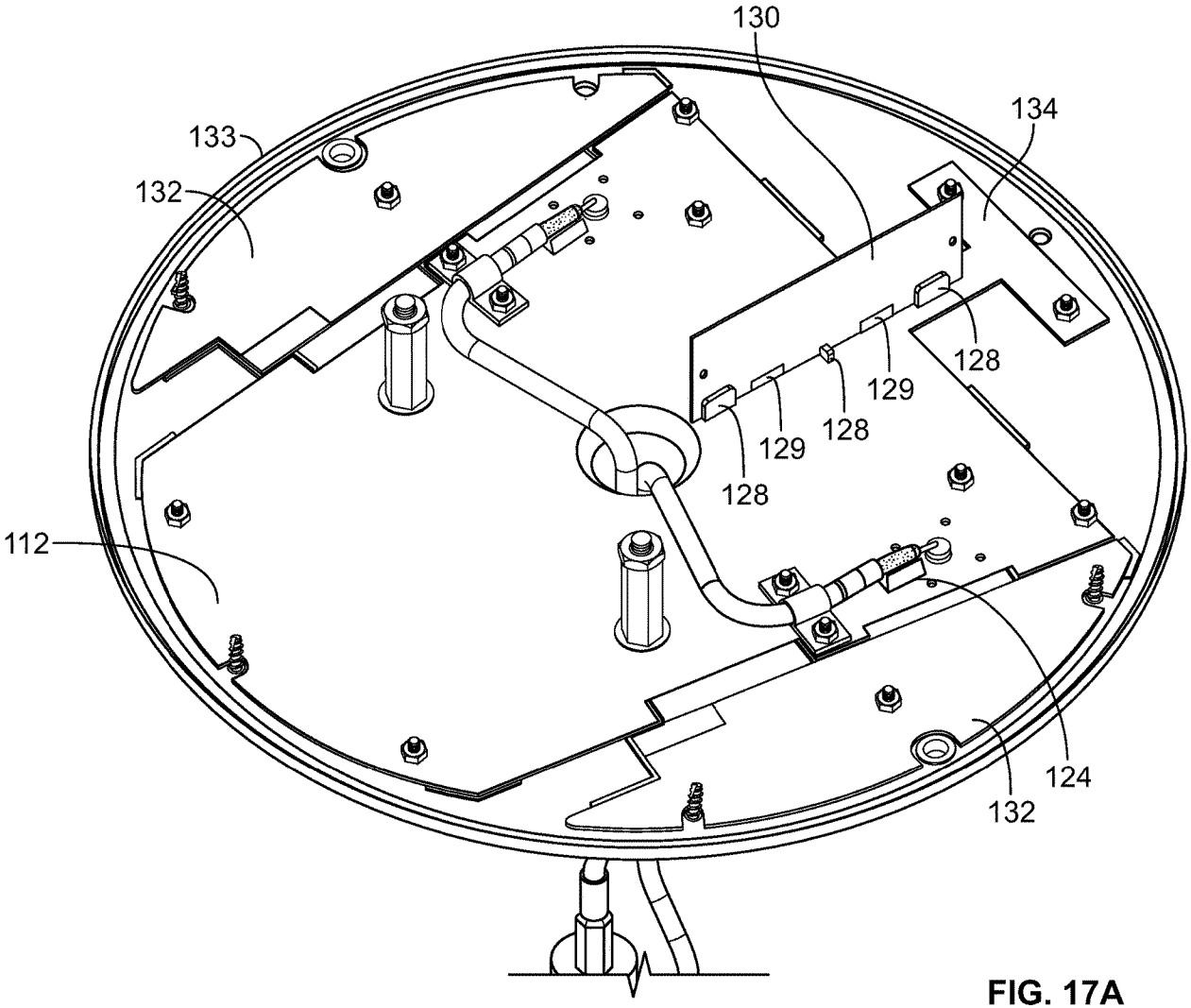
Figure 17B:
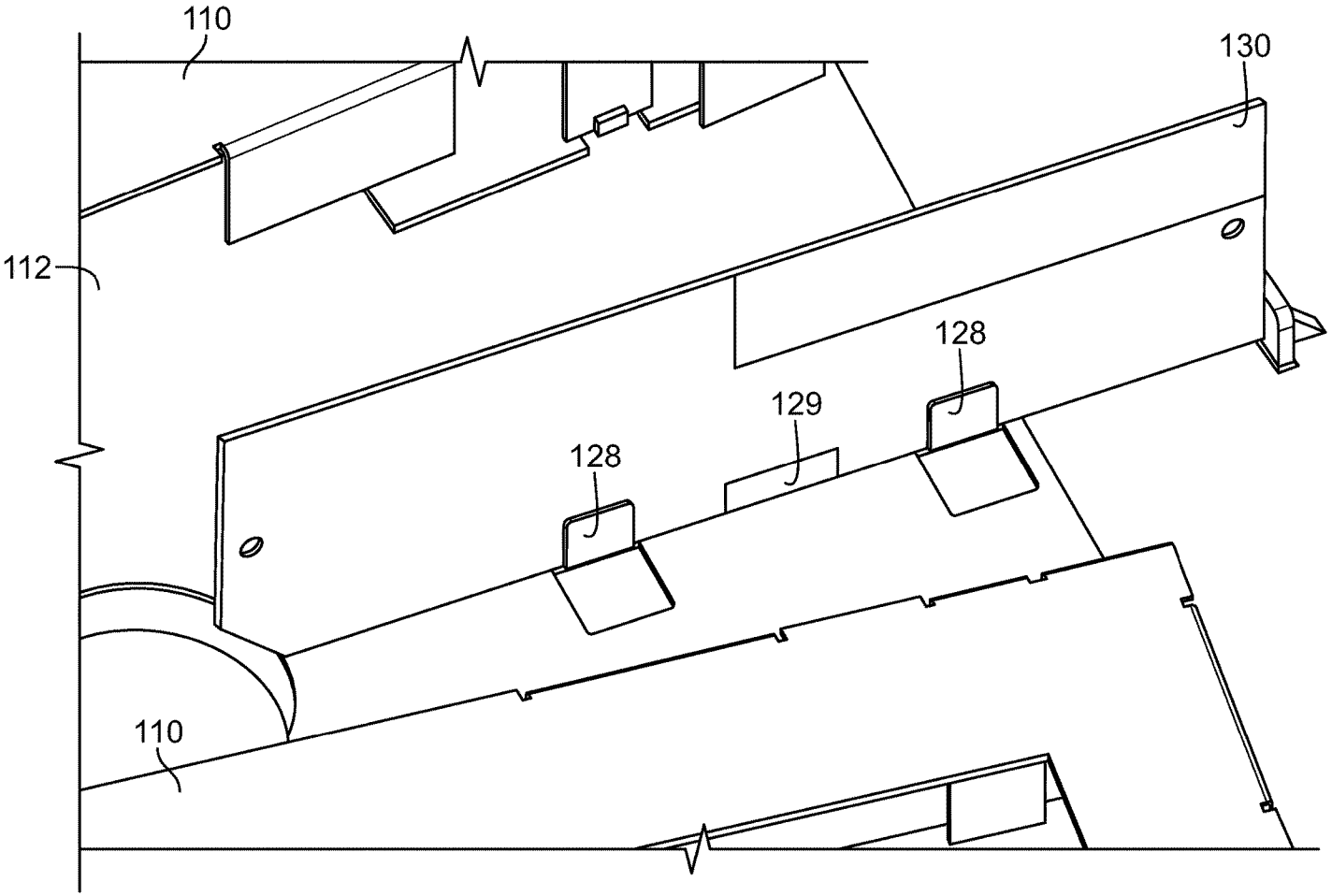
Figure 18C:
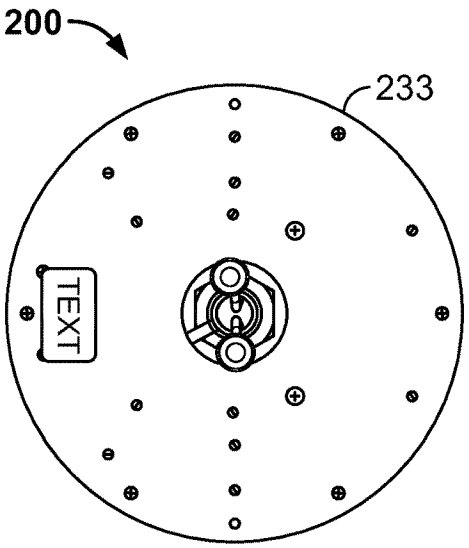
Figure 18B:
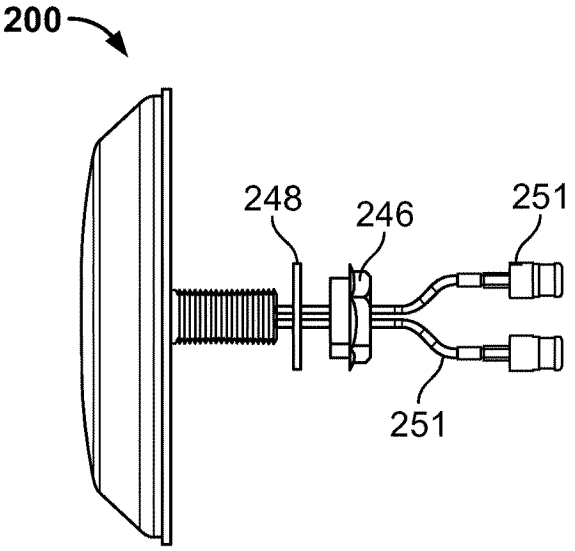
Figure 18A:
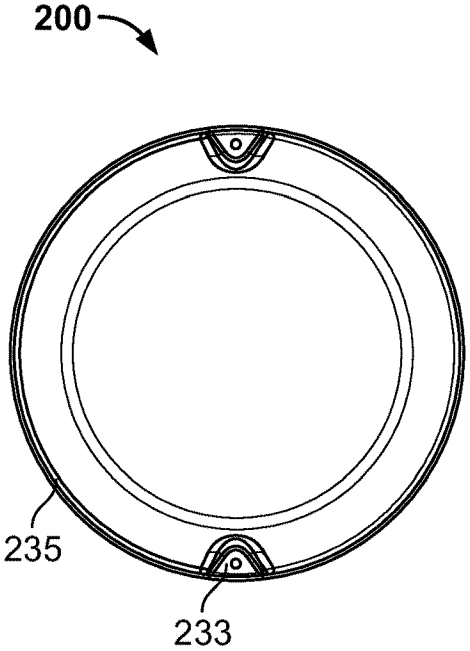
Figure 19A:
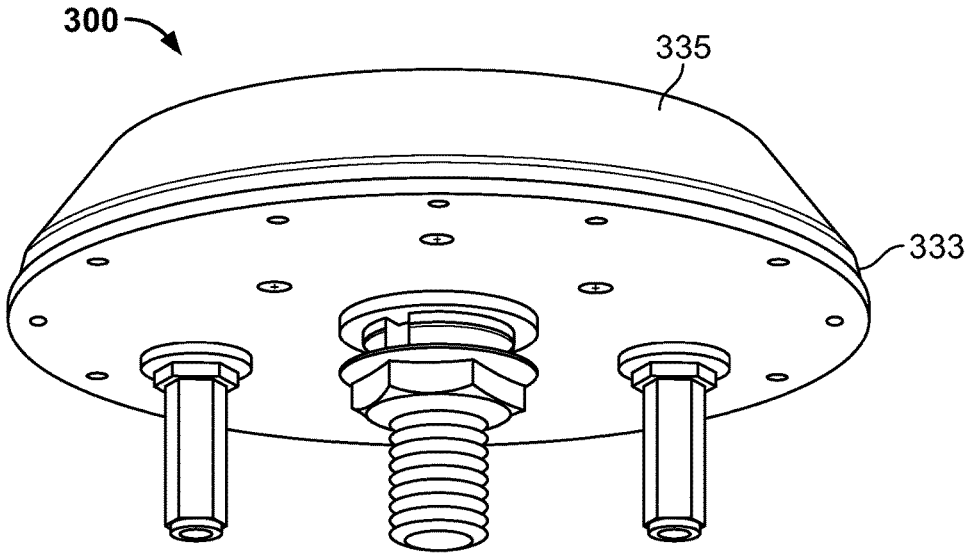
Figure 19B:
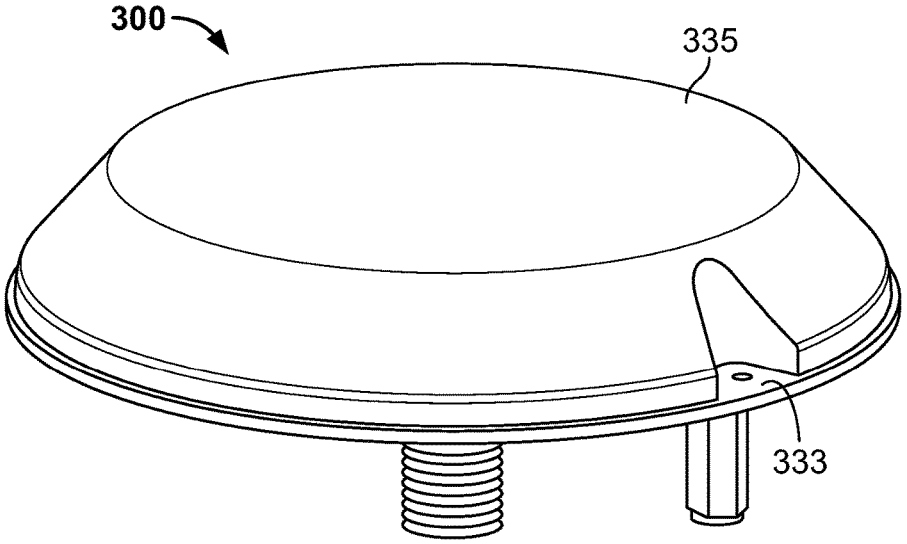
Figure 20:
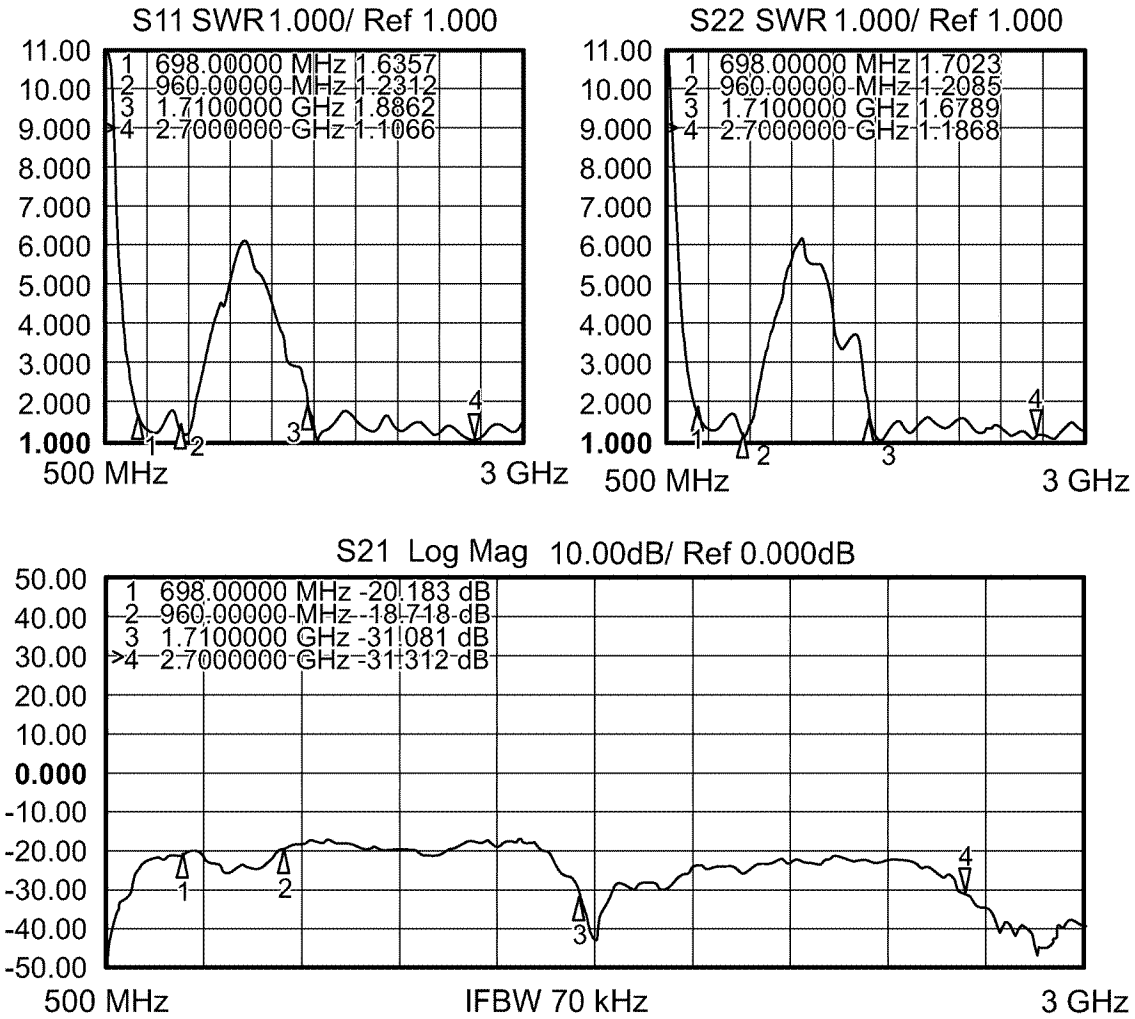
Figure 21:
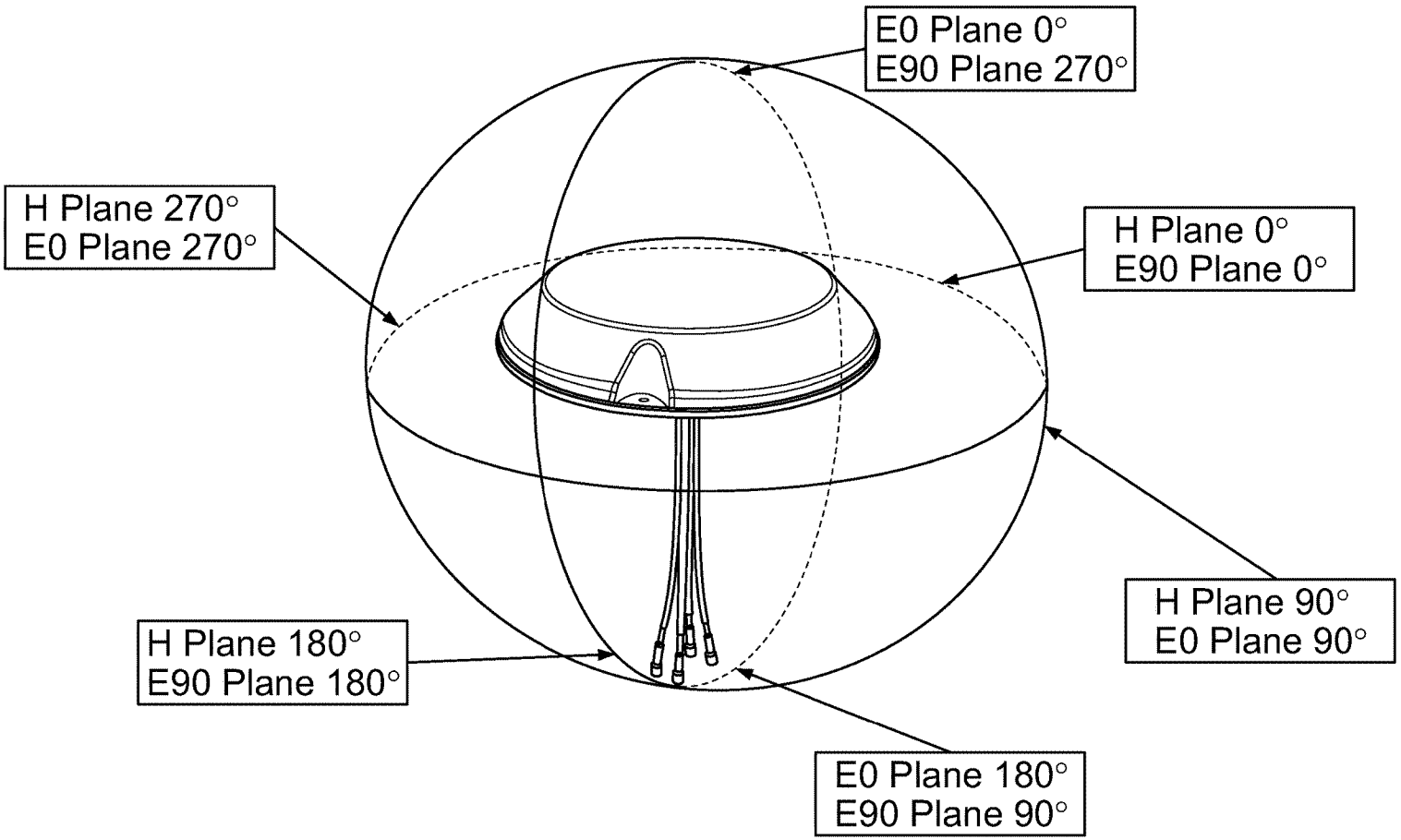
Figure 22:
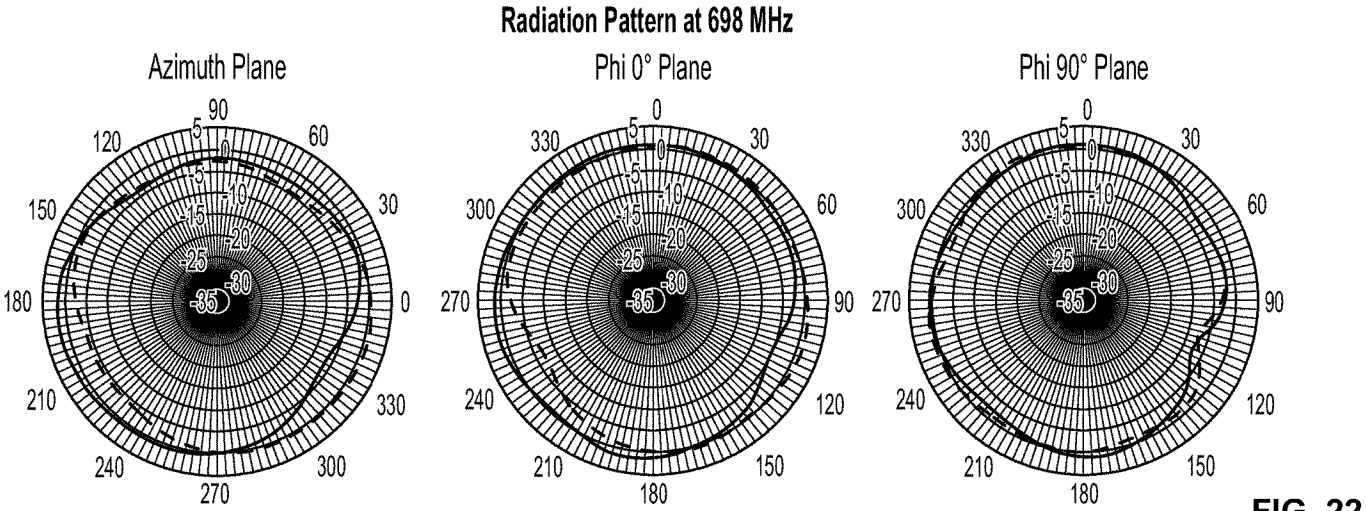
Figure 23:
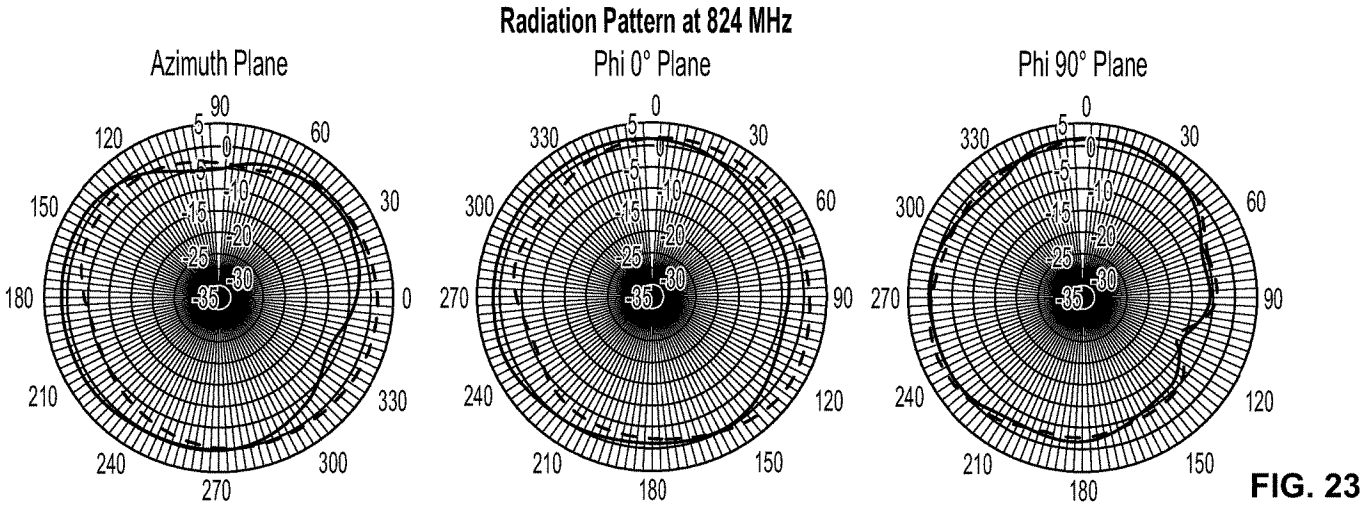
Figure 24:
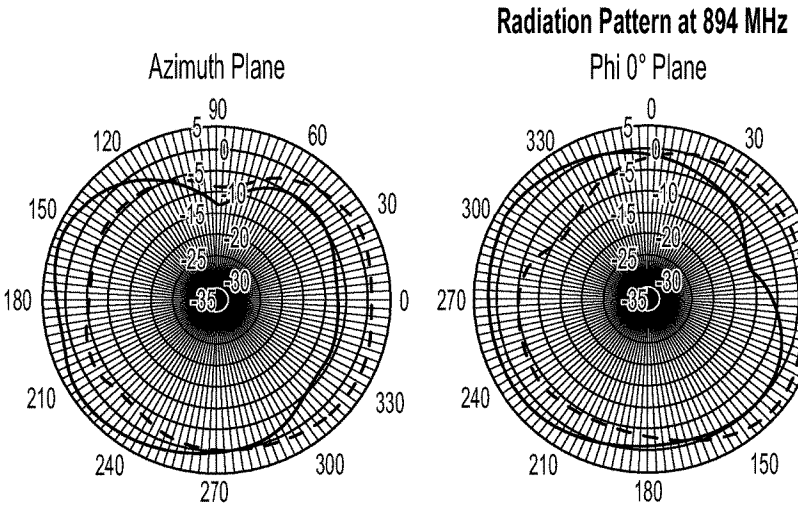
Figure 25:
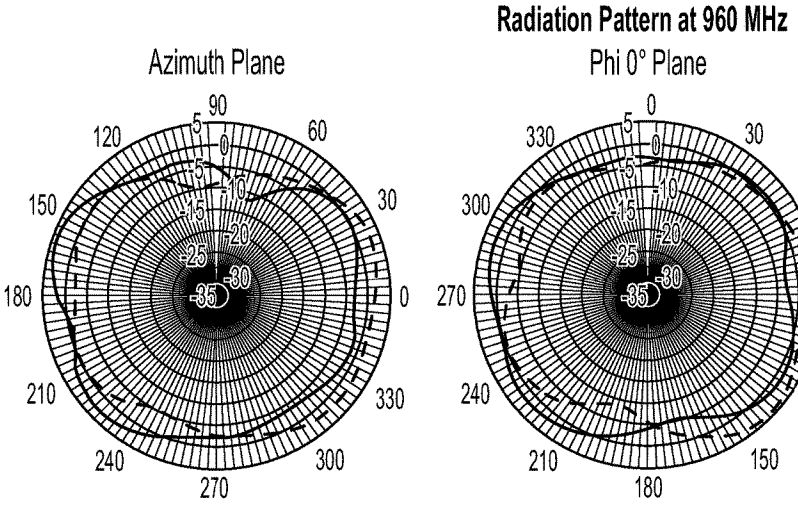
Figure 26:
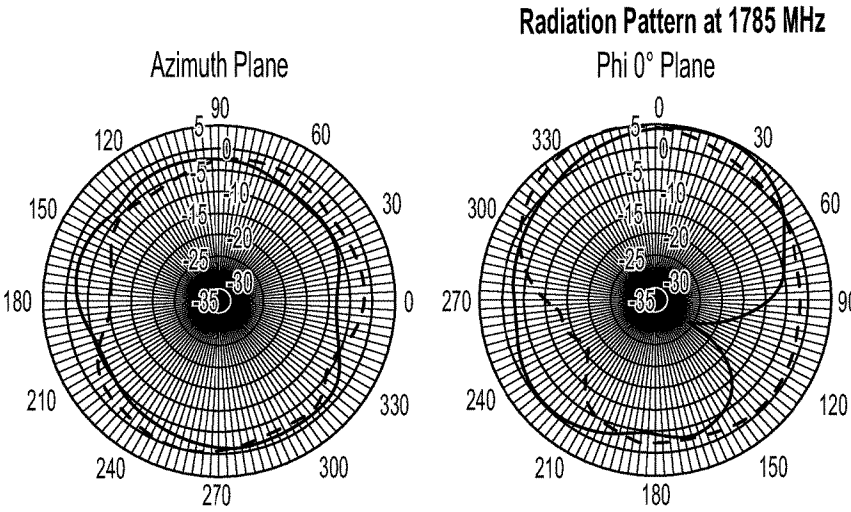
Figure 27:
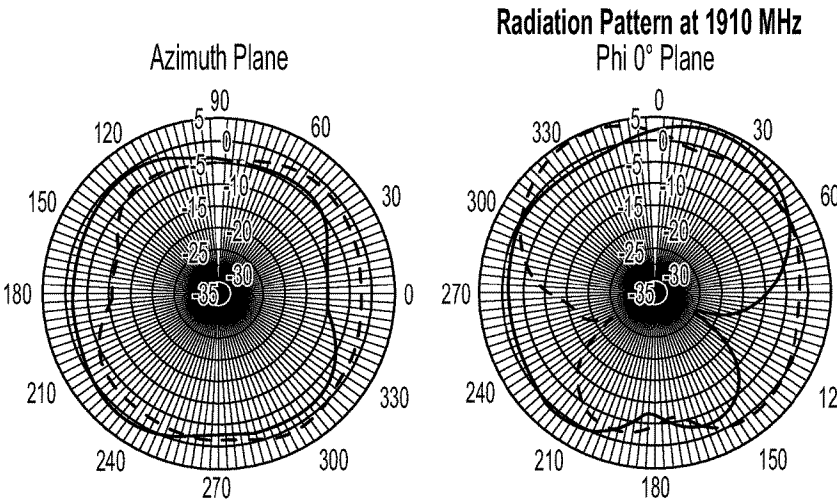
Figure 28:
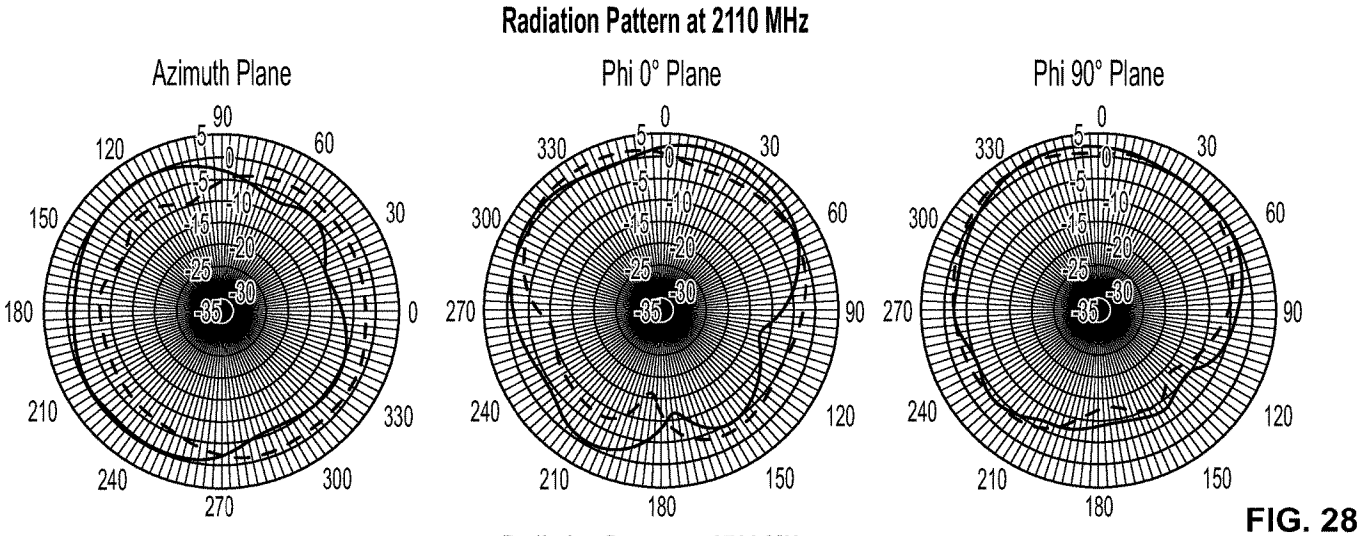
Figure 29:
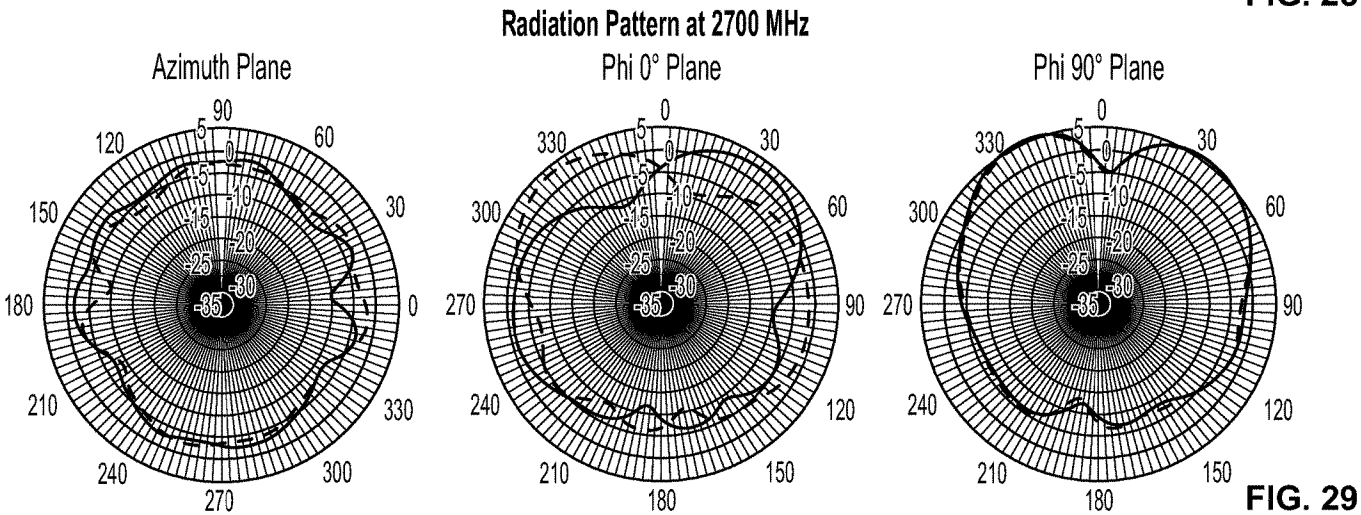
Figure 30:
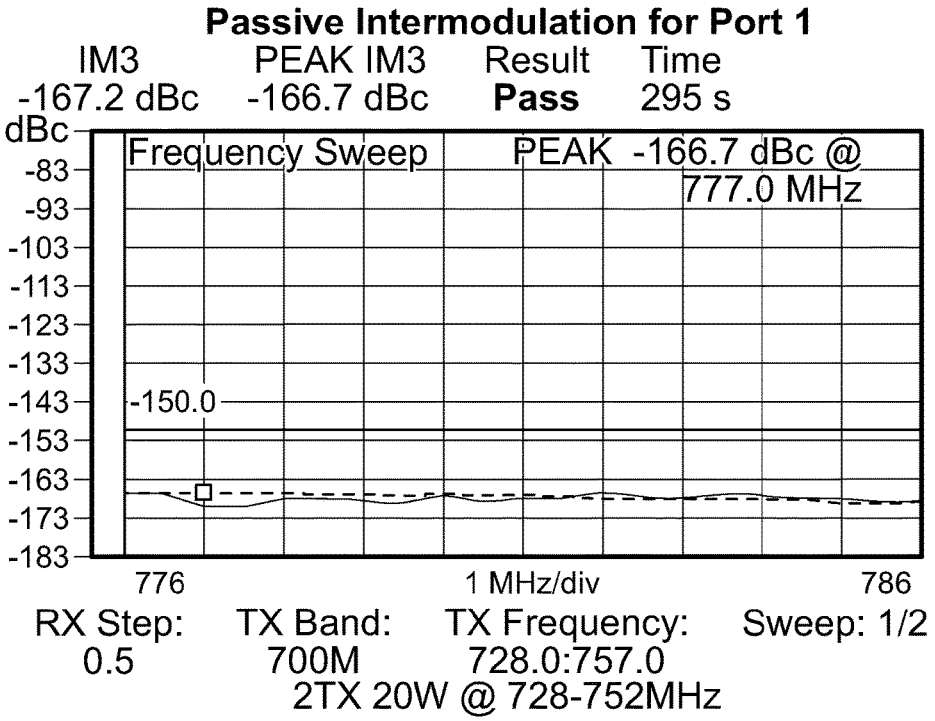
Figure 30:
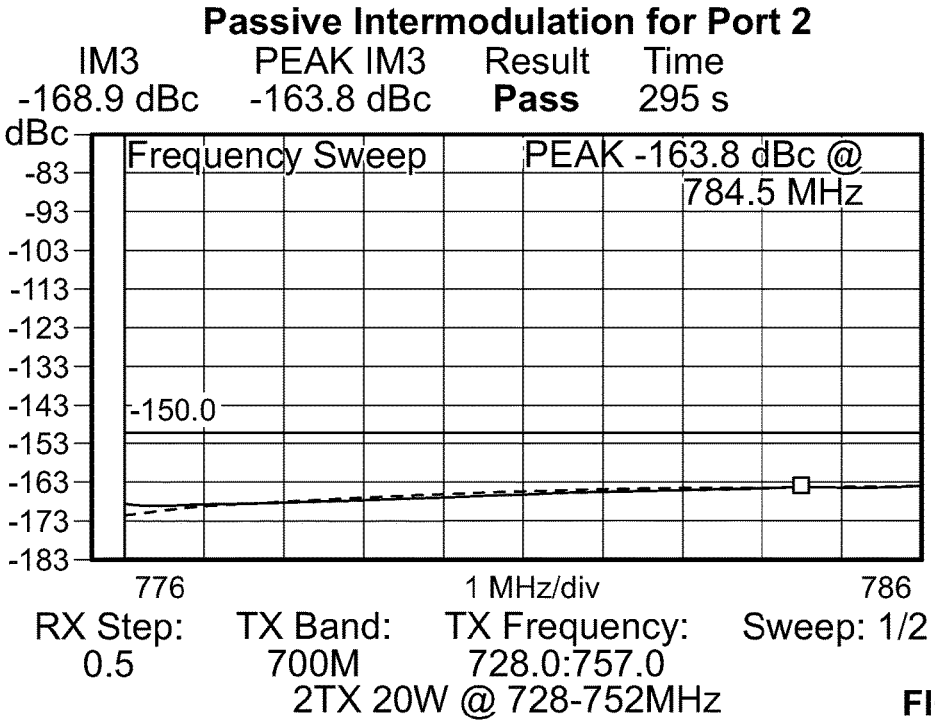
Figure 31:
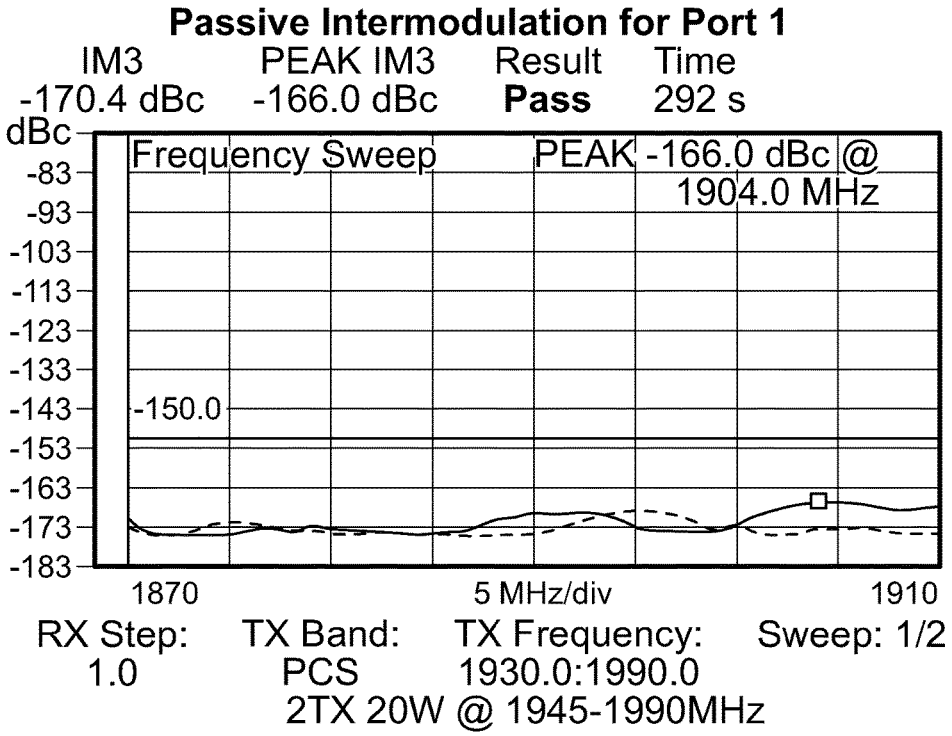
Figure 31:
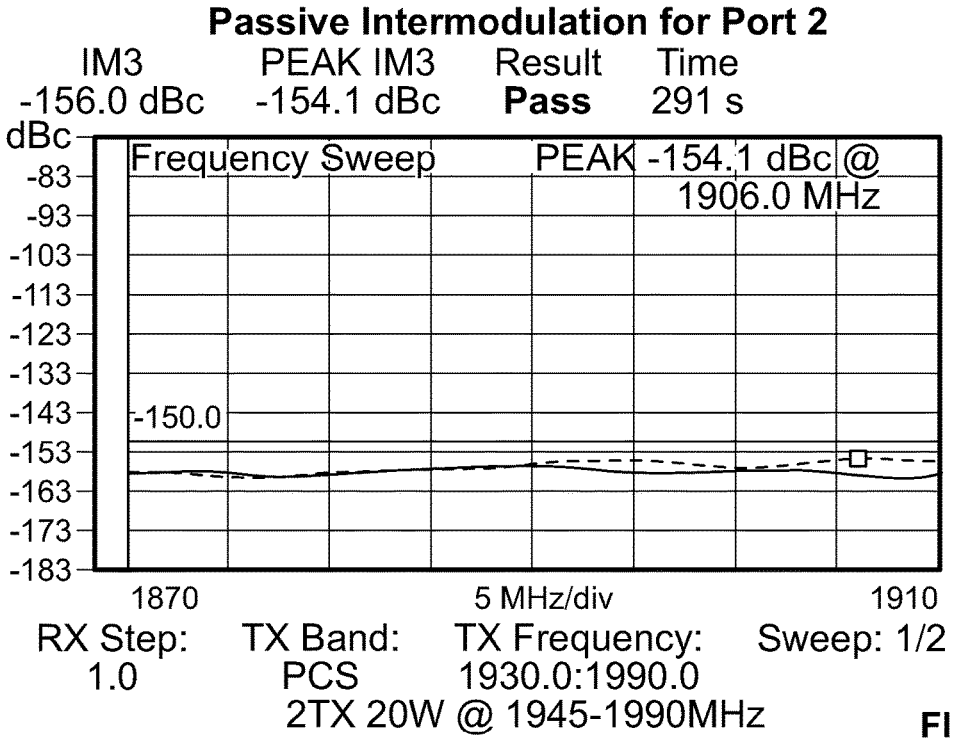
Figure 32:
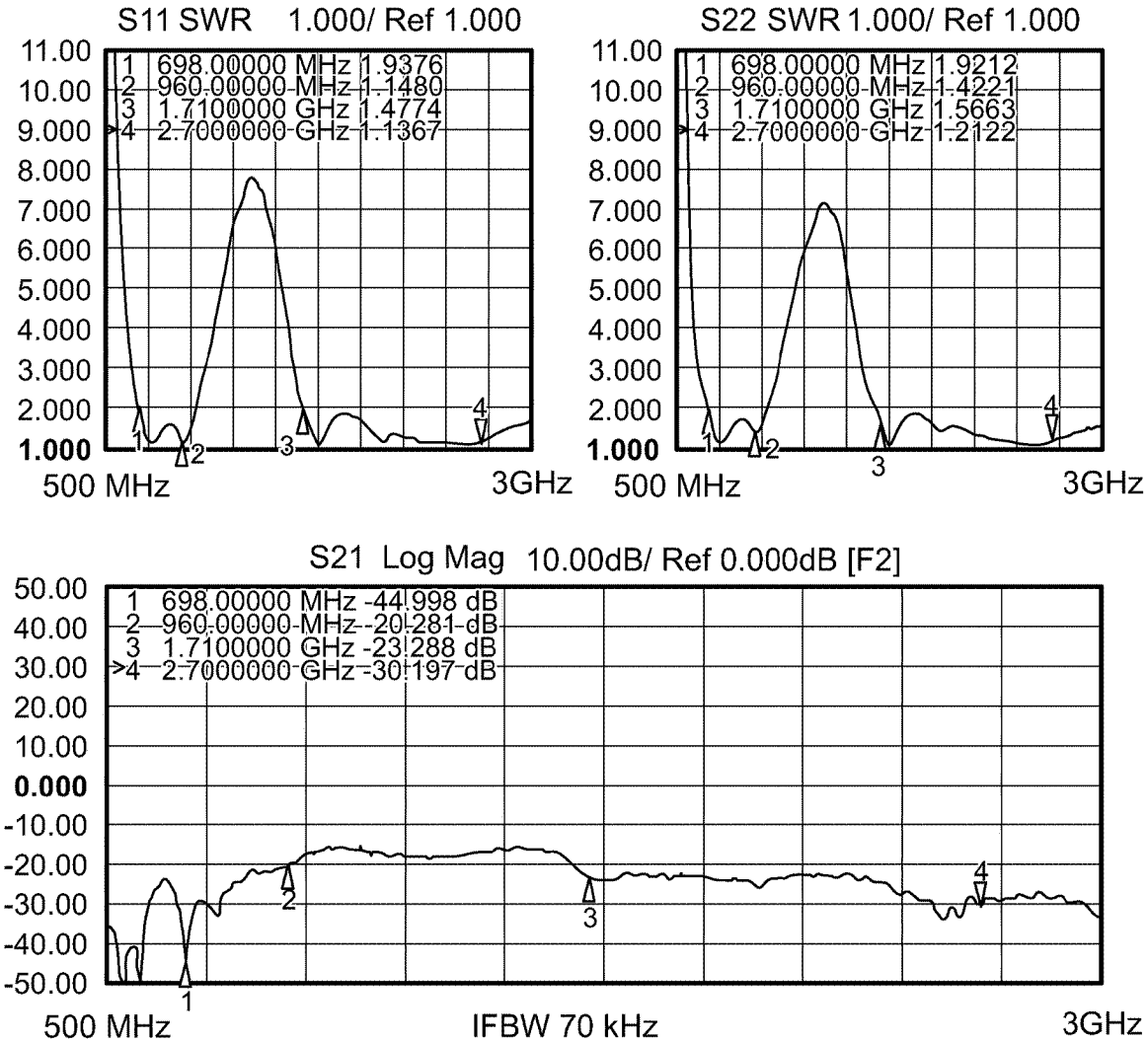
Figure 33:
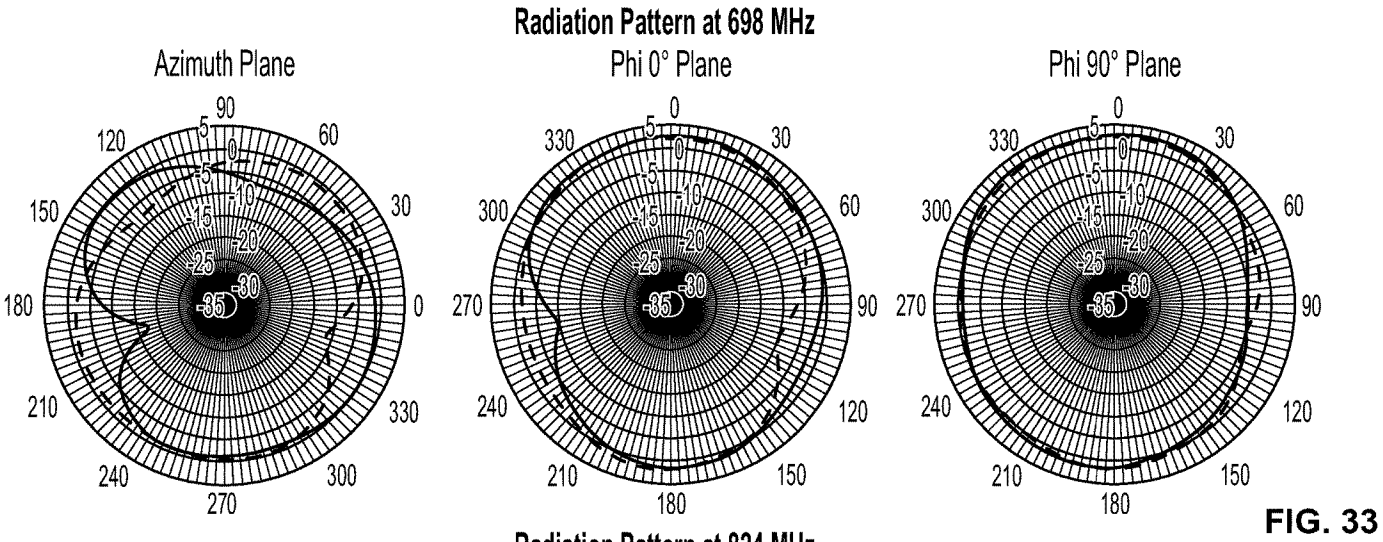
Figure 34:
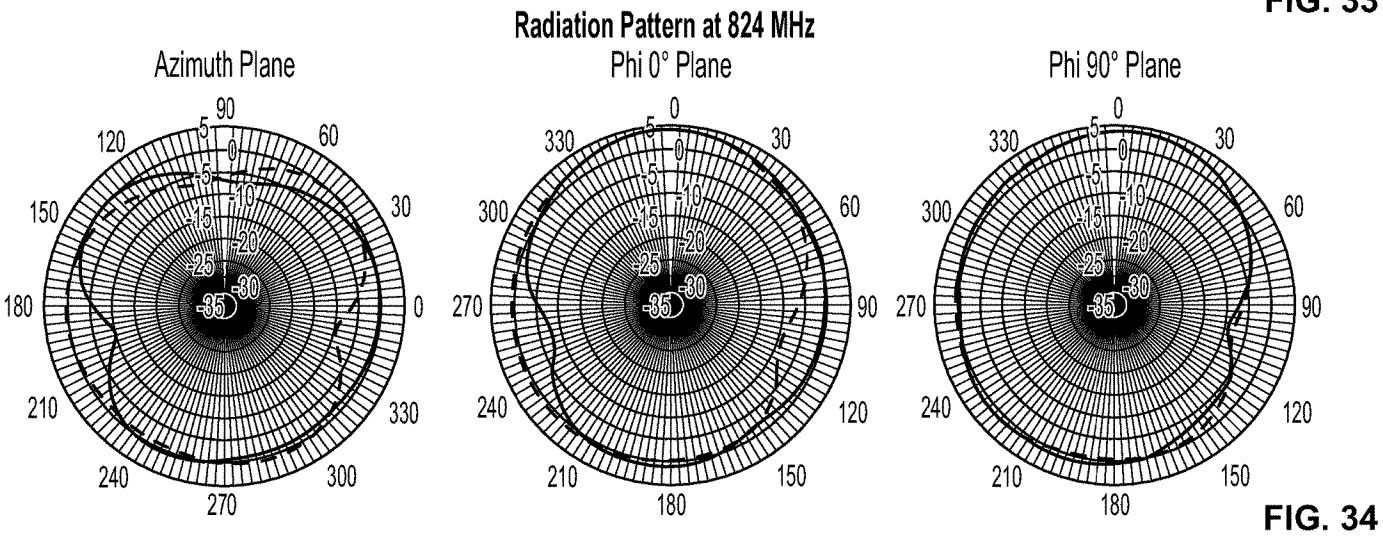
Figure 35:
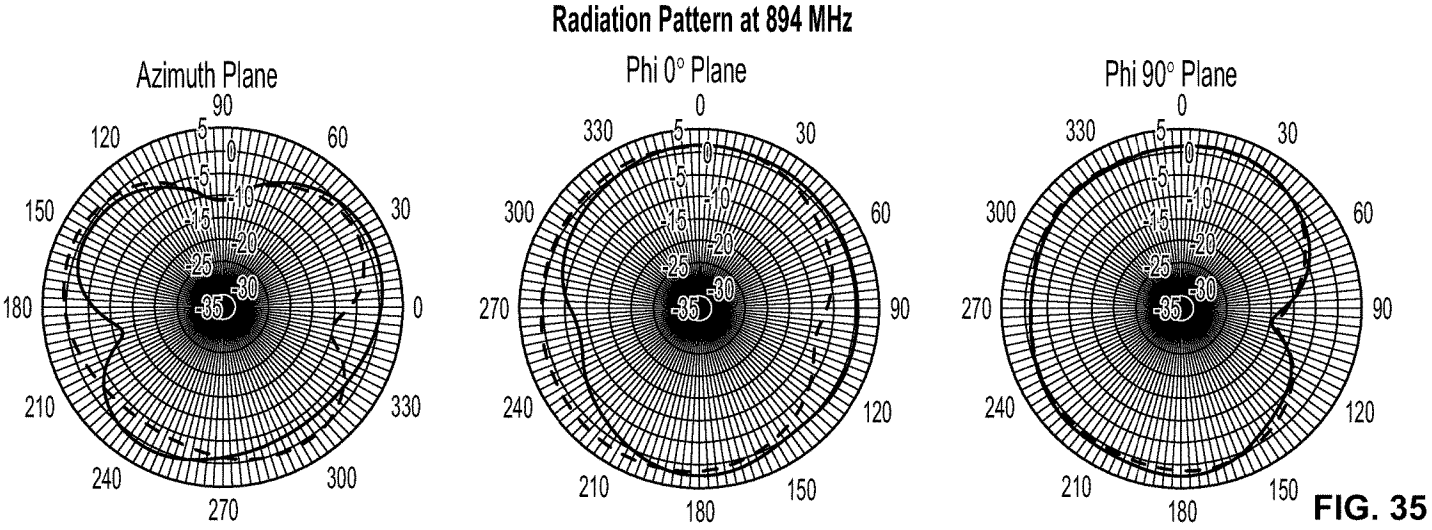
Figure 36:
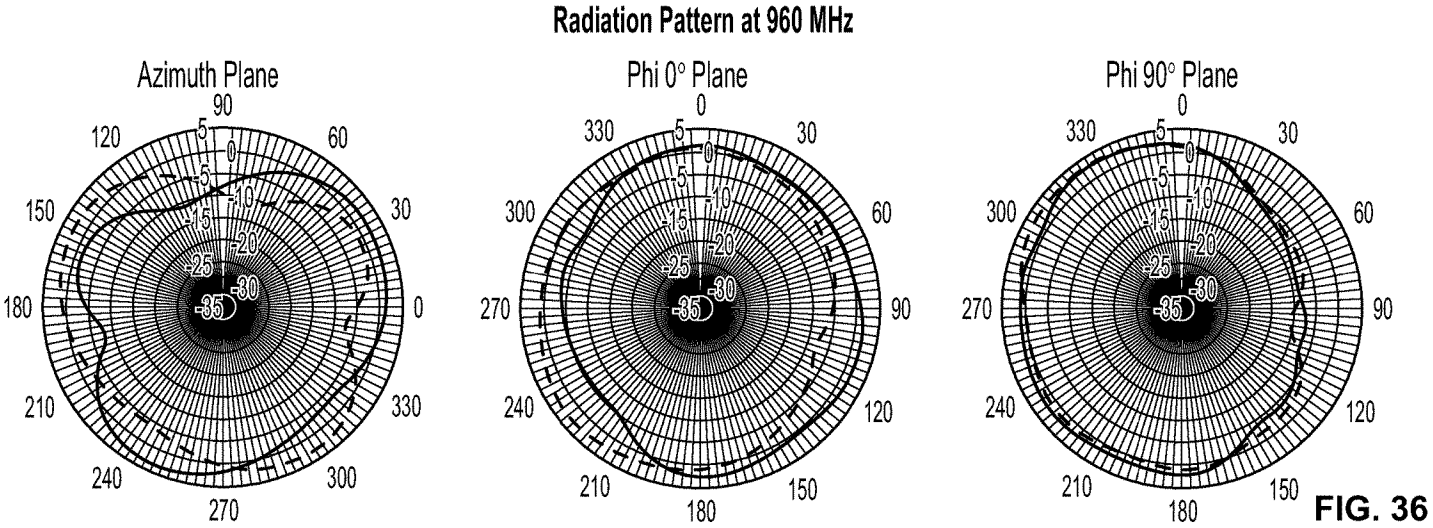
Figure 37:
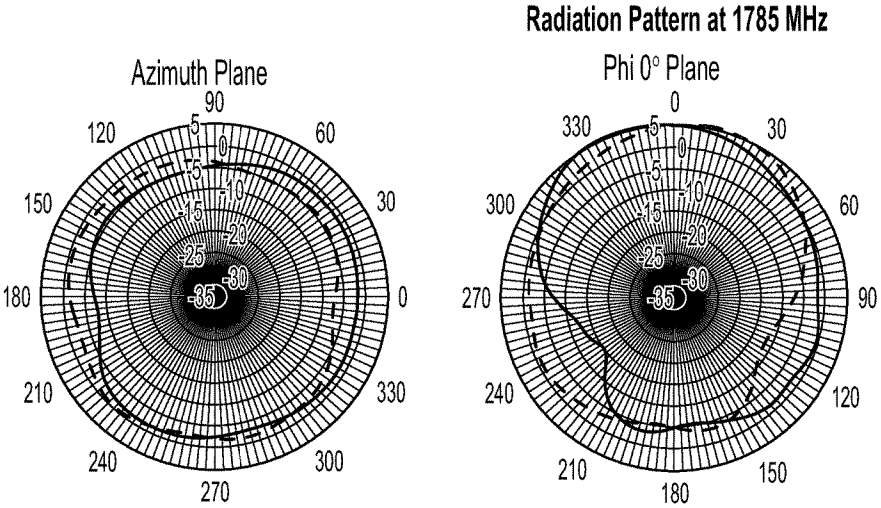
Figure 38:
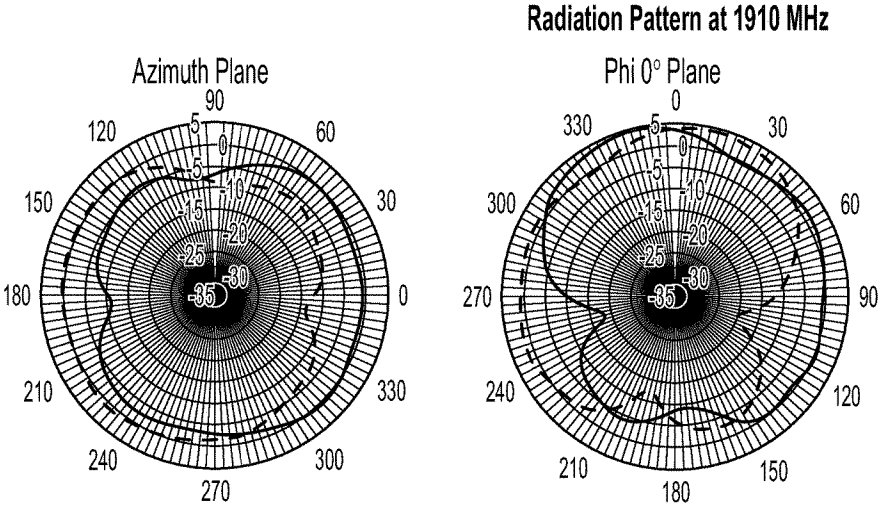
Figure 39:
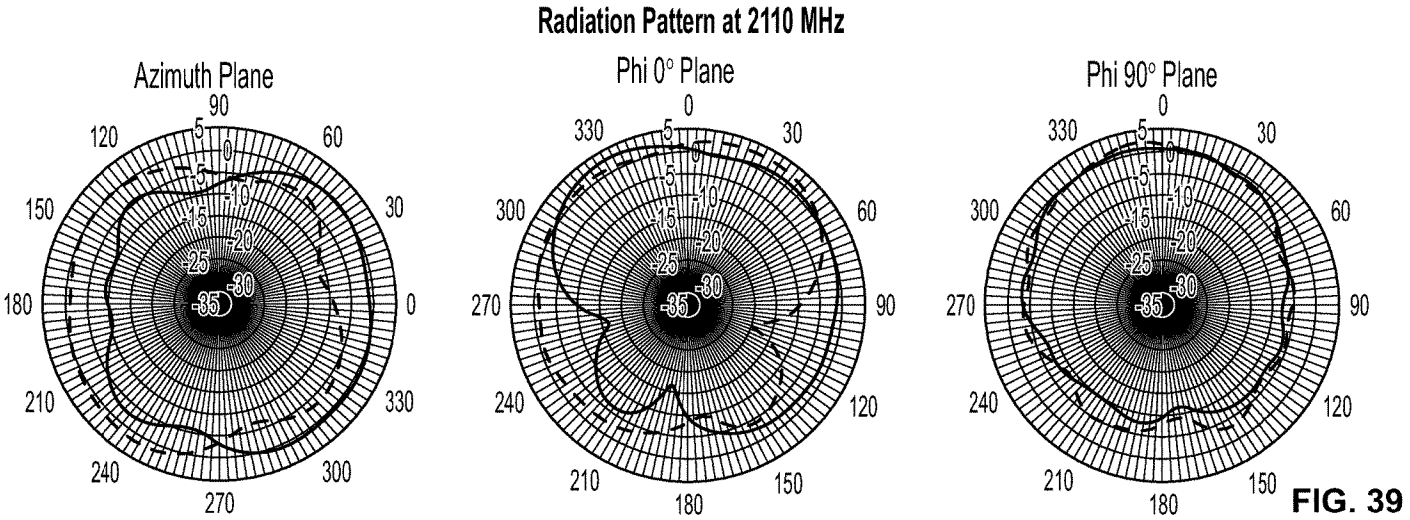
Figure 40:
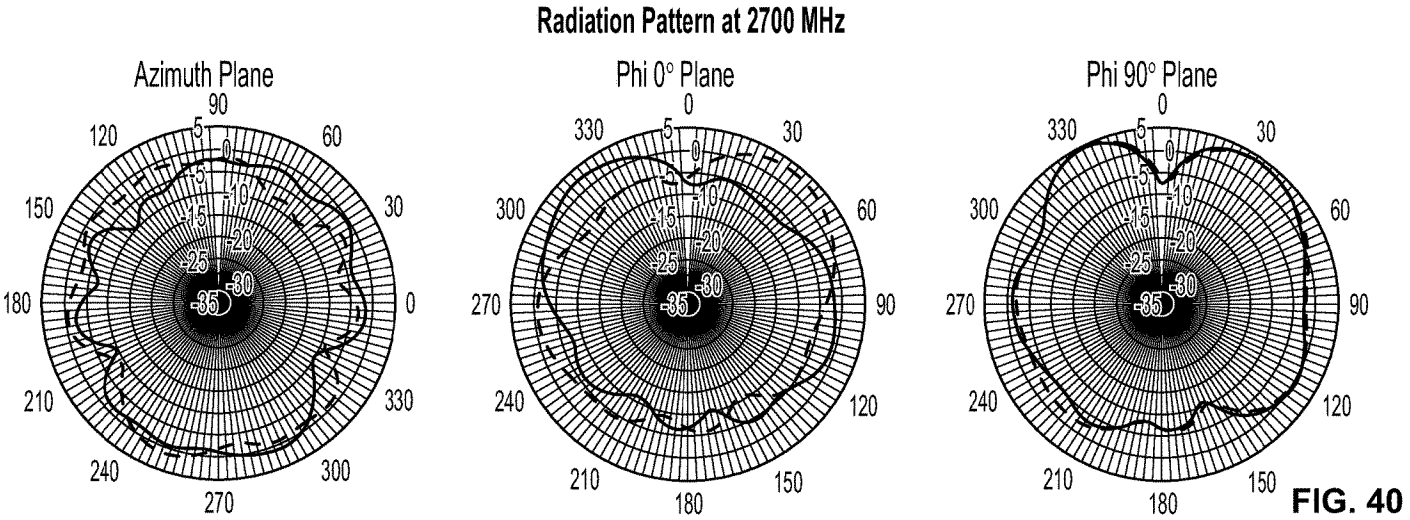
Figure 41:
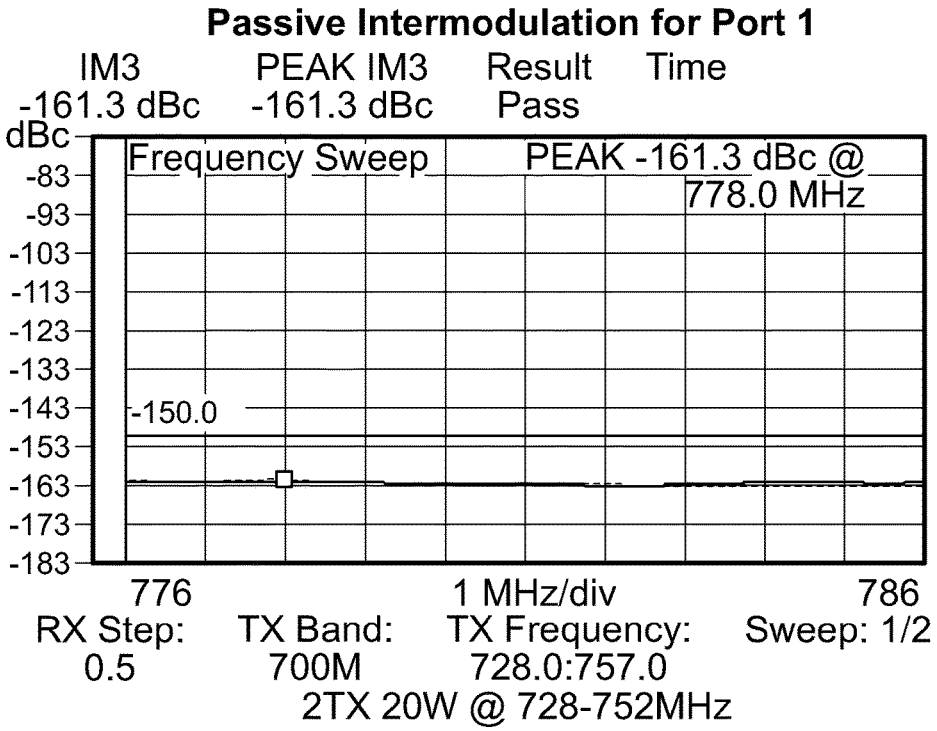
Figure 41:
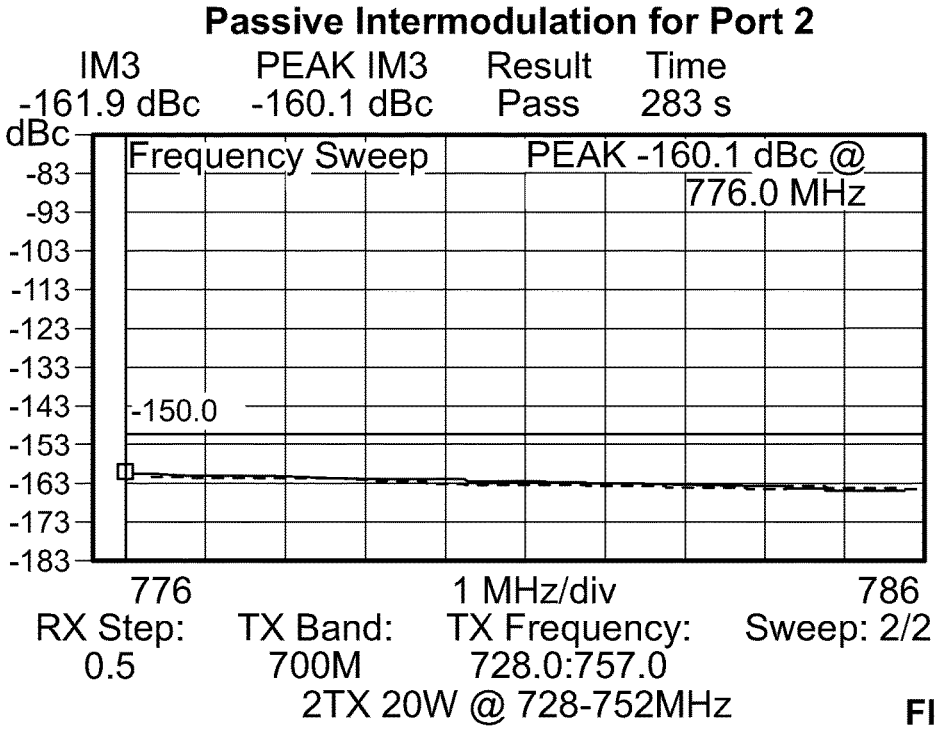
Figure 42:
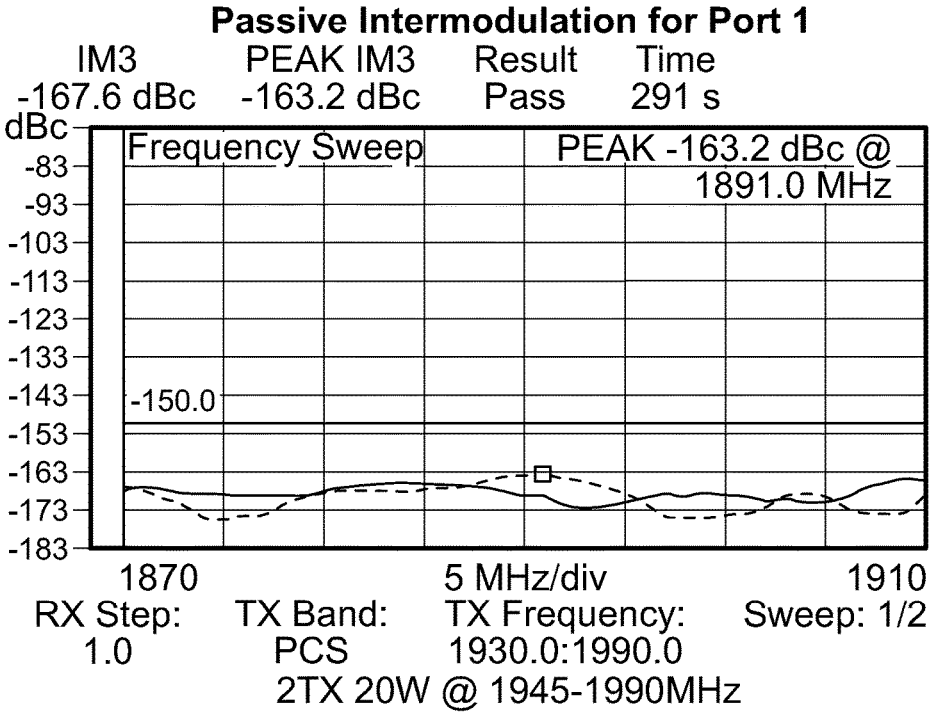
Figure 42:
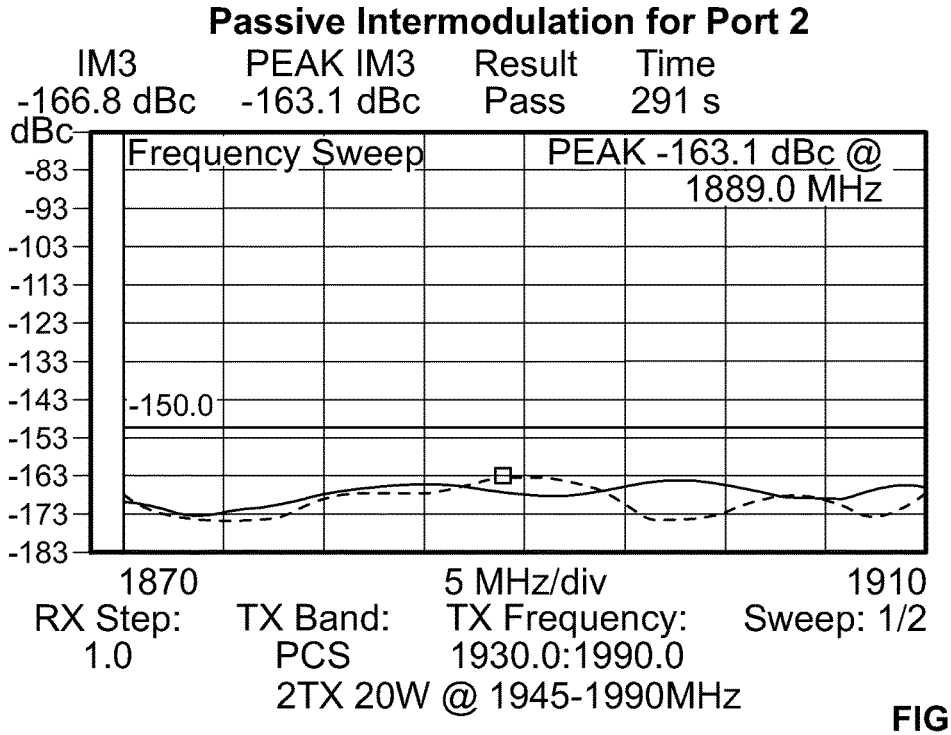

FIGS. 12A, 12B, and 12C are respective side and end views of the NF bulkhead connector shown in FIG. 11, where exemplary dimensions (in millimeters, after plating) are provided for purposes of illustration only according to exemplary embodiments;

FIG. 13 is a partial perspective view showing the exemplary way that the center conductor and four outer conductors/contacts of the NF bulkhead connector may be respectively connected to the ground plane and antenna of the antenna system shown in FIGS. 2 through 5;

FIG. 14 is a perspective view of an exemplary antenna that may be used with an antenna system according to exemplary embodiments, where the antenna includes a removed portion for connector soldering purposes, an added tab for center conductor soldering purposes, and a tab that is small and/or reduced in size to minimize (or at least reduce) PIM issues and inconsistent soldering;

FIGS. 15A, 15B, and 15C are respectively inner, outer, and partial perspective views of a base that may be used with the antenna system of FIGS. 2 through 5 according to exemplary embodiments;

FIG. 16A is a perspective view of a ground plane and parasitic elements that may be used in the antenna system shown in FIGS. 2 through 5 according to an exemplary embodiment, where the ground plane includes holes for the contacts of the NF connector shown in FIG. 10 and openings for a PCB holder directly formed (e.g., molded, etc.) in the base plate, and where the dimension and shape of the gap between the parasitic elements and the ground plane may be used for adjusting the resonance for high and low band;

FIG. 16B is a perspective view of a portion of the ground plane that may be used in the antenna system shown in FIGS. 2 through 5 according to another exemplary embodiment, where the ground plane includes holes for the contacts of the NF connector shown in FIG. 10 and a PCB holder directly or integrally formed (e.g., stamped and bent tabs, etc.) from the ground plane;

FIG. 17A is a perspective view of the ground plane and parasitic elements shown in FIG. 16A mounted to a base, and also illustrating the exemplary way that a printed circuit board (PCB) or vertical wall isolator may be held by a PCB holder of the base that passes through openings in the ground plane shown in FIG. 16A;

FIG. 17B illustrates the exemplary way that a printed circuit board (PCB) or vertical wall isolator may be held by the PCB holder of the ground plane shown in FIG. 16B;

FIGS. 18A, 18B, and 18C are respective top, side, and bottom plan views of the antenna system shown in FIGS. 2 through 5 after being positioned within an interior enclosure cooperatively defined by a base and radome, and also illustrating an exemplary pigtail type connector configuration according to exemplary embodiments;

FIGS. 19A and 19B are respective bottom and top perspective views of the antenna system shown in FIGS. 2 through 5 after being positioned within an interior enclosure cooperatively defined by a base and radome, and also illustrating an exemplary fixed N-female (NF) bulkhead connector configuration according to exemplary embodiments;

FIG. 20 includes exemplary line graphs of Voltage Standing Wave Ratio (VSWR) (S11, S22) and isolation (S21 in decibels) versus frequency measured for a prototype of the example antenna system shown in FIGS. 2 through 5 within the radome and with the pigtail connection as shown in FIG. 18B;

FIG. 21 shows the pattern orientation and planes relative to the antenna prototype with the pigtail connection during radiation pattern testing;

FIGS. 22 through 29 illustrate radiation patterns (azimuth plane, Phi 0° plane, and Phi 90° plane) measured for the first and second multi-band antennas (shown in broken lines and solid lines) of the prototype of the example antenna system shown in FIGS. 2 through 5 with the pigtail connection and pattern orientation shown in FIG. 21 at frequencies of about 698 megahertz (MHz), 824 MHz, 894 MHz, 960 MHz, 1785 MHz, 1910 MHz, 2110 MHz, and 2700 MHz, respectively;

FIGS. 30 and 31 are exemplary line graphs of PIM (in decibels relative to carrier (dBc)) versus frequency (in MHz)) measured for ports 1 and 2 of the prototype of the example antenna system shown in FIGS. 2 through 5 with the pigtail connection shown in FIG. 18B, where the line graphs show the low PIM performance (e.g., less than −150 dBc, etc.) at both a low band (FIG. 30) and a high band (FIG. 31);

FIG. 32 includes exemplary line graphs of Voltage Standing Wave Ratio (VSWR) (S11, S22) and isolation (S21 in decibels) versus frequency measured for a prototype of the example antenna system shown in FIGS. 2 through 5 within the radome and with the fixed NF bulkhead connector shown in FIG. 19A;

FIGS. 33 through 40 illustrate radiation patterns (azimuth plane, Phi 0° plane, and Phi 90° plane) measured for the first and second multi-band antennas (shown in solid lines and broken lines) of the prototype of the example antenna system shown in FIGS. 2 through 5 with the fixed NF bulkhead connection shown in FIG. 19A (and same pattern orientation as in FIG. 21) at frequencies of about 698 MHz, 824 MHz, 894 MHz, 960 MHz, 1785 MHz, 1910 MHz, 2110 MHz, and 2700 MHz, respectively; and FIGS. 41 and 42 are exemplary line graphs of PIM (in dBc) versus frequency (in MHz) measured for ports 1 and 2 of the prototype of the example antenna system shown in FIGS. 2 through 5 with the fixed NF bulkhead connector shown in FIG. 19A, where the line graphs show the low PIM performance (e.g., less than −150 dBc, less than −153 dBc, etc.) at both a low band (FIG. 41) and a high band (FIG. 42).

DETAILED DESCRIPTION

Example embodiments will now be described more fully with reference to the accompanying drawings.

The inventors hereof have recognized a need for relatively low profile antenna systems that have low PIM (Passive Intermodulation) (e.g., able to qualify as a low PIM rated design, etc.), good or improved bandwidth (e.g., meet the LTE/4G application bandwidth from 698-960 MHz and from 1710-2700 MHz, etc.), good or improved isolation (e.g., at low band, etc.), and/or provide more VSWR margin at production. Accordingly, disclosed herein are exemplary embodiments of antenna systems (e.g., 100 (FIGS. 2-5), 200 (FIGS. 18A, 18B, 18C), 300 (FIGS. 19A and 19B), etc.) that have a low PIM rated design or configuration.

In exemplary embodiments, a low PIM design may be realized by reducing galvanic metal-to-metal contact surface and minimizing (or at least reducing) soldering area, along with good or improved bandwidth and isolation by introducing parasitic elements and a unique isolator configuration. The low PIM design also has the design flexibility and capability to accommodate both a pigtail connector type (e.g., FIGS. 18B and 21, etc.) and a fixed connector type (e.g., FIGS. 10A and 19A, etc.) with good or improved performance consistency. The disclosed exemplary embodiments have superior or increased bandwidth, improved isolation without compromising overall bandwidth, and improved or low PIM.

According to aspects of the present disclosure, exemplary embodiments may include one or more (or all) of the following features to realize or achieve low PIM. In an exemplary embodiment, the antenna system preferably does not include any ferromagnetic material or ferromagnetic components including right plating that could otherwise be a source of PIM. Instead, the radiating elements and ground plane (e.g., antennas 110 and ground plane 112 in FIGS. 2 and 3, etc.) may instead be made of brass or other suitable non-ferromagnetic material. The connectors and cable are preferably PIM rated components.

The radiating element grounding may be based on proximity couple grounding by introducing dielectric adhesive tape (broadly, dielectric member) below the radiating elements to avoid direct galvanic contact between the radiating elements and the ground plane. See, for example, FIG. 3 in which dielectric adhesive tape 113 is aligned for positioning between the antenna 110 and ground plane 112.

There may be relatively small areas for soldering the contacts of the connector to the ground plane. Accordingly, the connector may be connected or grounded to the ground plane with a relatively small area soldering contact. See, for example, FIG. 13 in which there are four relatively small soldering areas for soldering the contacts 122 of the connector 114 (FIG. 10A) to the ground plane 112 (FIG. 13).

A dielectric member may be positioned between an upper surface of the connector and the ground plane to electrically insulate and minimize (or at least reduce) direct galvanic contact between the connector's upper surface and the ground plane. See, for example, FIG. 2 in which a circular dielectric or insulator 116 (e.g., FR-4 fiberglass reinforced epoxy laminate material, etc.) is aligned for positioning between the upper surface of the connector 114 and the ground plane 112.

Figure 6:
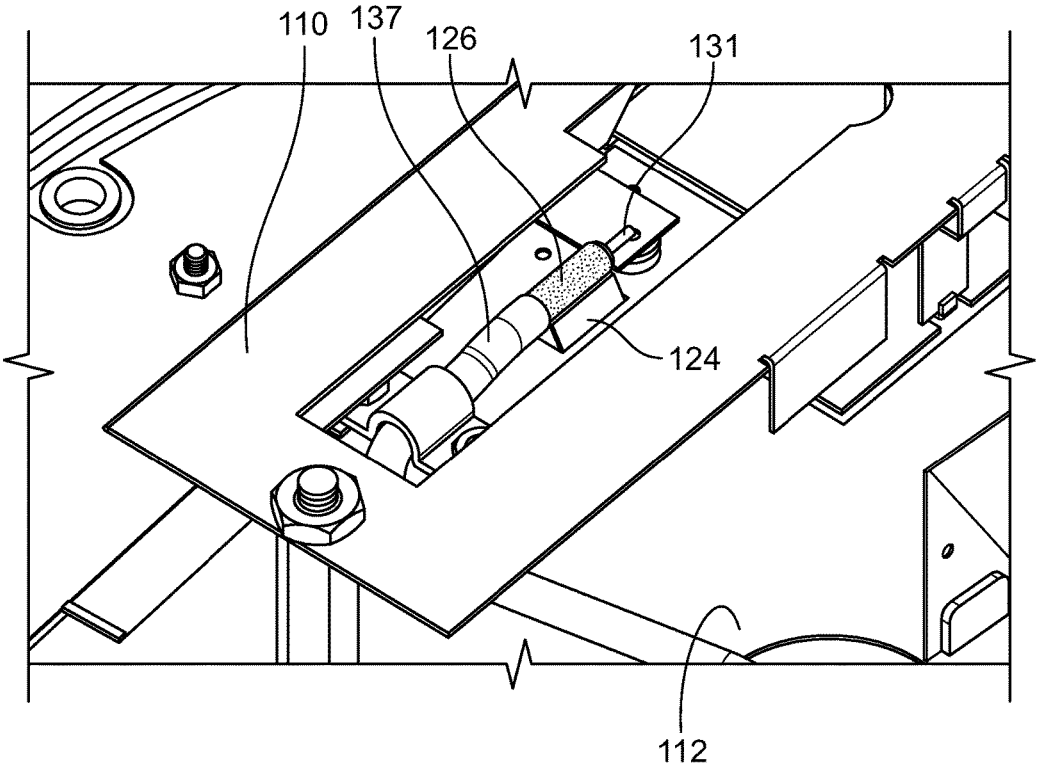
FIG. 6 is a partial perspective view of the coaxial cable and antenna shown in FIG. 5, and illustrating the exemplary way that a cable holder may be directly formed from the ground plane.
Figure 8:
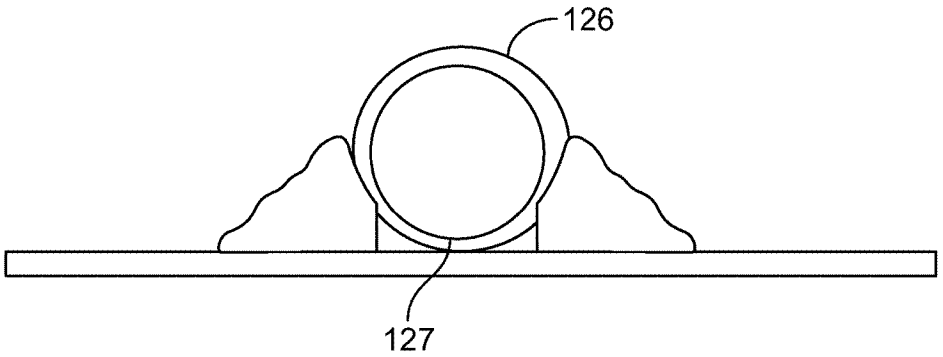
FIG. 8 (Prior Art)
FIG. 8 illustrates a conventional way for soldering a coaxial cable braid to a ground plane.
Figure 9:
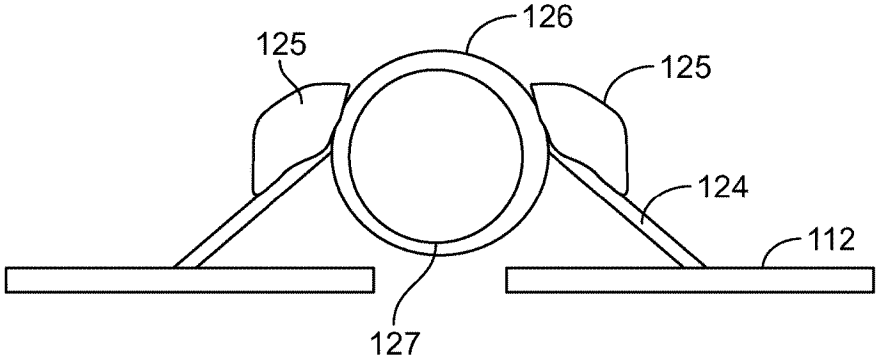
FIG. 9 illustrates an exemplary way for soldering a coaxial cable braid to a cable holder integrally formed from a ground plane according to exemplary embodiments.

Further, the ground plane may include an integrally formed (e.g., stamped, etc.) feature for soldering a cable braid. This feature provides minimum (or at least reduced) direct galvanic contact surface between the cable braid and the ground plane as only the cross section of the integrally formed feature contacts the ground plane. Advantageously, this helps to prevent (or at least reduce) any inconsistency in the contact between the cable braid and the ground plane. See, for example, FIGS. 6, 7, and 9 in which a cable holder 124 has been directly formed (e.g., stamped, etc.) from the ground plane 112. FIG. 9 shows a cable braid 126 soldered to the stamped cable holder 124. By comparison, FIG. 8 illustrates a conventional way for soldering a coaxial cable braid to a ground plane, which may introduce inconsistent contact especially along the bottom of the cable braid where solder is not present. In FIG. 9, there is no contact along the bottom of the cable braid 126, which is hollow or open due to the stamping and repositioning of ground plane material to make the cable holder 124.

The ground plane and/or base may also include one or more integrally formed (e.g., stamped, etc.) features for holding a PCB or vertical wall isolator to reduce solder areas, e.g., by eliminating the need for solder pads on the ground plane that would otherwise be used for attaching the PCB to the ground plane. The reduced solder areas reduce PIM and inconsistency that may arise with soldering. See, for example, FIGS. 2, 16A, and 17A in which a PCB holder 128 is directly molded from and protrudes outwardly from the base 133 (e.g., plastic base plate, etc.). Pieces or portions of the PCB holder 128 pass through openings 123 (FIG. 16A) in the ground plane 112. As shown in FIG. 17A, the pieces of the PCB holder 128 may retain or hold a PCB or vertical wall isolator 130 such that only a single or two solder pads 129 is needed for electrically connecting the PCB or isolator 130 to the ground plane 112. Alternatively, FIGS. 16B and 17B illustrate an example in which the ground plane 112 includes a PCB holder directly formed (e.g., stamped and bent tabs 128, etc.) from the ground plane 112. The PCB holder of the ground plane 112 may retain or hold a PCB or vertical wall isolator 130 such that only a single solder pad 129 is needed for electrically connecting the PCB or isolator 130 to the ground plane 112.

According to other aspects of the present disclosure, exemplary embodiments may include one or more features to realize or achieve good or improved bandwidth. In an exemplary embodiment, parasitic elements are added or introduced adjacent or beside the radiating elements to enhance bandwidth for both low and high band while maintaining good isolation between radiators. See, for example, FIGS. 4 and 5 in which first and second parasitic elements 132 are positioned adjacent or beside the first and second antennas 110, respectively, without making direct galvanic contact therewith.

According to further aspects of the present disclosure, exemplary embodiments may include one or more features to realize or achieve good or improved isolation. In an exemplary embodiment, an isolator is added between two radiating elements thereby improving isolation at low band by increasing the ground surface electrically. See, for example, FIG. 5 in which a T-shaped isolator 134 extends outwardly from the ground plane 112 and increases the ground surface electrically. The improved isolation allows more antenna radiating elements to be positioned in the same volume of space or allows a smaller overall antenna assembly to be used for the same number of antenna radiating elements (e.g., for an end use where space is limited or compactness is desired, etc.).

FIGS. 2 through 5 illustrate an exemplary embodiment of an antenna system or assembly 100 embodying one or more aspects of the present disclosure. As disclosed herein, the antenna system 100 is configured so as to have low PIM as well as good bandwidth and isolation.

The antenna system 100 includes two antennas 110 spaced apart from each other on a ground plane 112. In this example, the antennas 110 are identical to each other and symmetrically placed relatively close to each other on the ground plane 112. In alternative embodiments, the antennas 110 may be asymmetrically placed, may be dissimilar or non-identical, and/or configured differently than the antenna 110. By way of example, another exemplary embodiment may include one or more antennas (e.g., PIFAs, etc.) as disclosed in PCT International Patent Application WO 2012/112022, the entire contents of which is incorporated herein by reference.

Figure 3:
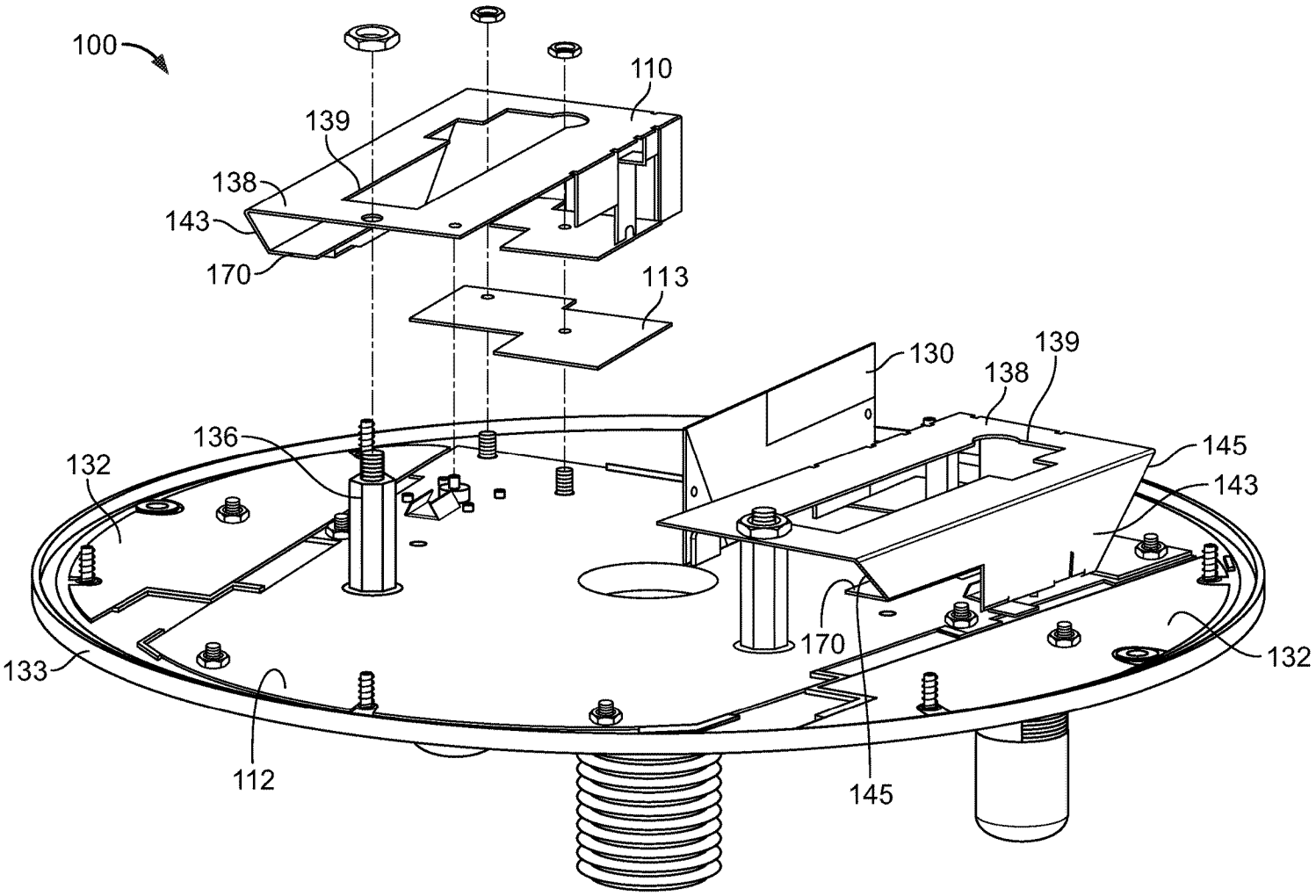
FIG. 3 is another exploded perspective view of the antenna system shown in FIG. 2, where the ground plane (and vertical wall isolator and antenna coupled thereof) are mounted to a base.

As shown in FIG. 3, dielectric adhesive tape 113 (broadly, dielectric member) is used between the bottom surface of the antennas 110 and the ground plane 112, to avoid direct galvanic contact between the antennas 110 and the ground plane 112. Accordingly, the radiating element grounding in this example is based on proximity couple grounding.

The antennas 110 may be coupled to the base 133 via mechanical fasteners, etc. For example, the antennas 110 and tape 113 include openings therethrough for receiving mechanical fasteners. In addition, dielectric standoffs 136 may be positioned or slotted between the base 133 and the upper surface or radiating patch element 138 of the antennas 110. The standoffs 136 are configured to physically or mechanically support the upper radiating patch elements 138 of the antennas 110 with sufficient structural integrity. Alternative embodiments may be configured differently, such as without the standoffs or with different means for supporting the radiating patch elements and/or for coupling the antennas to the base.

With continued reference to FIGS. 2 through 5, first and second parasitic elements 132 are positioned adjacent or beside the first and second antennas 110, respectively, such that the parasitic elements 132 do not make direct galvanic contact with the antennas 110 or ground plane 112. In this example, the first and second parasitic elements 132 are identical and symmetrically placed relative to each other when coupled (e.g., mechanically fastened, etc.) to the base 133 (e.g., base plate, etc.). The introduction of the parasitic elements 132 enhances the antenna's bandwidth for both low and high band while maintaining good isolation between the antennas 110. Also, the dimension and shape of the gap 149 may be adjusted to provide minor tweaking of the resonance for high and low band (FIG. 16A).

The antenna system 100 includes first and second isolators 130 and 134. The dimensions, shapes, and locations of the isolators 130, 134 relative to the antennas 110 and ground plane 112 may be determined (e.g., optimized, etc.) to improve the isolation and/or to enhance bandwidth.

Figure 5:
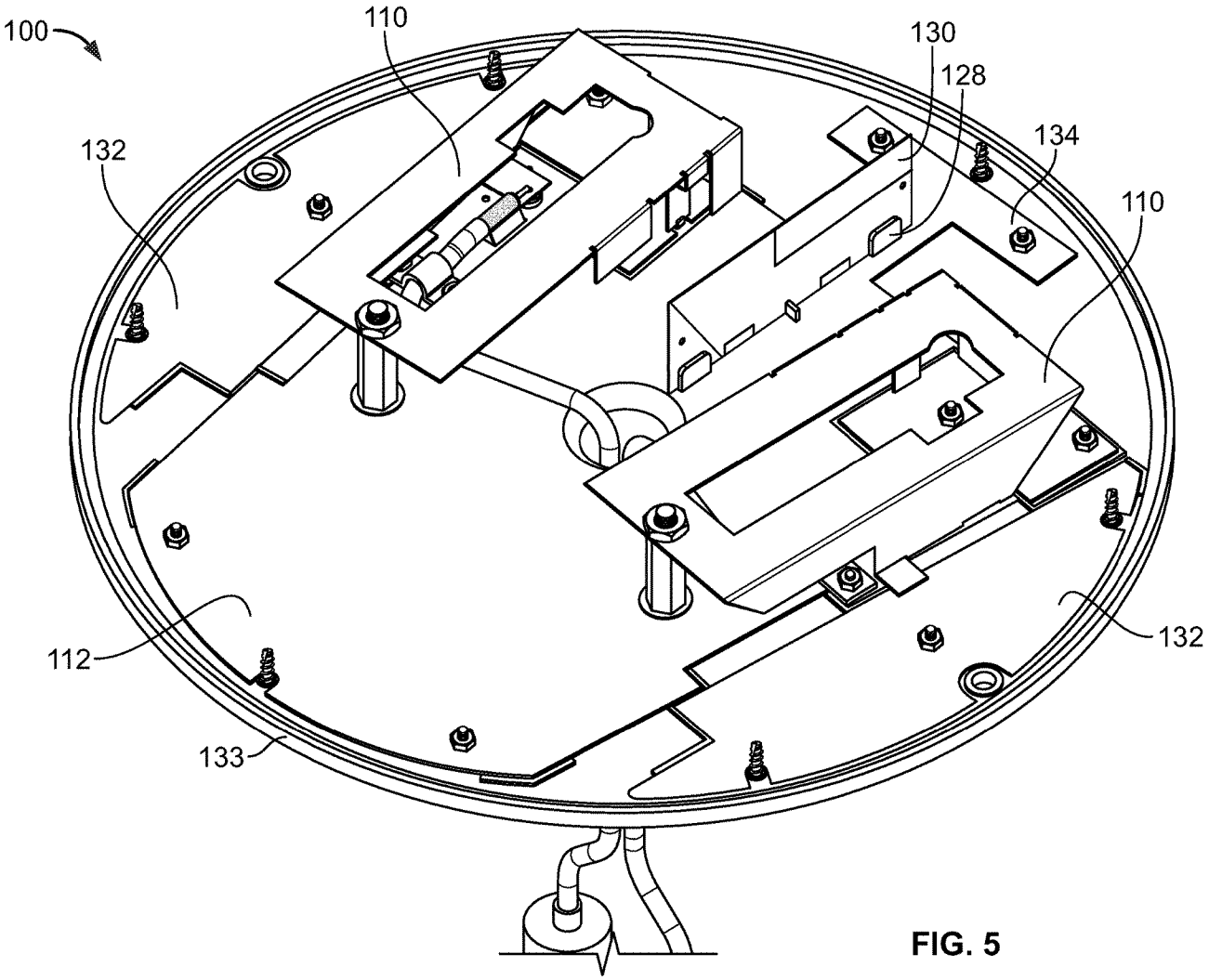
FIG. 5 is a perspective view of the antenna system shown in FIG. 4, and also illustrating an exemplary coaxial cable connected to an antenna.

As shown in FIG. 5, the second isolator 134 is generally T-shaped and extends outwardly from the ground plane 112 to thereby increase the ground surface electrically. The isolator 134 is generally between the antennas 110 such that isolation is improved at low band by increasing the ground surface electrically. In this example, the isolator 134 is an integral piece or part of the ground plane 112 that has been formed (e.g., stamped, etc.) to have a T-shape that is co-planar with the ground plane 112. Alternative embodiments may include an isolator that is not T-shaped and/or that is a separate, non-integral piece electrically connected to the ground plane.

As shown in FIGS. 5 and 17A-B, the first isolator 130 comprises a vertical wall isolator. The vertical wall isolator 130 may be configured such that its upper, free edge is the same height (e.g., 20 millimeters, etc.) above the ground plane 112 as the upper surfaces of the radiating patch elements 138 of the antennas 110. Alternative embodiments may include an isolator between the antennas 110 that is configured differently (e.g., non-rectangular, non-perpendicular to the ground plane, taller or shorter, etc.) than what is illustrated.

The vertical wall isolator 130 is held in place by the integral features of the base 133 and/or ground plane 112, which reduce solder areas, e.g., by eliminating the need for solder pads on the ground plane 112 that would otherwise be used for attaching the PCB to the ground plane 112. The reduced solder areas reduce PIM and inconsistency that may arise with soldering. See, for example, FIGS. 2, 16A, and 17A in which a PCB holder 128 is directly molded from and protrudes outwardly from the base 133 (e.g., plastic base plate, etc.). Pieces or portions of the PCB holder 128 pass through openings 123 (FIG. 16A) in the ground plane 112. As show in FIG. 17A, the pieces of the PCB holder 128 may retain or hold a PCB or vertical wall isolator 130 such that only a single or two solder pads 129 is needed for electrically connecting the PCB or isolator 130 to the ground plane 112.

Alternatively, FIGS. 16B and 17B illustrate another exemplary embodiment in in which the ground plane 112 includes a PCB holder directly formed (e.g., stamped and bent tabs 128, etc.) from the ground plane 112. The PCB holder of the ground plane 112 may retain or hold a PCB or vertical wall isolator 130 such that only a single solder pad 129 is needed for electrically connecting the PCB or isolator 130 to the ground plane 112. As shown in FIG. 16B, the ground plane 112 includes first and second stamped and bent tabs 128 that are generally opposite or opposing a third stamped and bent tab 128. The tabs 128 are generally perpendicular to the ground plane 112. The stamped and bent tabs 128 may retain or hold the vertical wall isolator 130 in place, such that only a single solder pad 129 (FIG. 17B) is needed for electrically connecting the isolator 130 to the ground plane 112. For example, the vertical wall isolator 130 has first and second opposite sides. The vertical wall isolator 130 is positioned relative to the tabs 128 such that at least one tab is along the first side of the vertical wall isolator 130 and at least one oppositely facing tab is along the second side of the vertical wall isolator 130, such that the tabs 128 cooperate to frictionally retain the vertical wall isolator 130 therebetween. This isolator mounting arrangement advantageously reduces solder areas, e.g., by eliminating the need for solder pads on the ground plane 112 that would otherwise be used for attaching the isolator 130 to the ground plane 112. The reduced solder areas reduce PIM and inconsistencies that may arise from soldering.

The vertical wall isolator 130 is generally perpendicular and vertical relative to the ground plane 112. In this particular illustrated embodiment, the antennas 110 are spaced equidistant from the vertical wall isolator 130. The antennas 110 are symmetrically arranged on opposite sides of the vertical wall isolator 130 about an axis of symmetry through or defined by the vertical wall isolator 130, such that each antenna 110 is essentially a mirror image of the other.

During operation, the vertical wall isolator 130 improves isolation. The frequency at which the isolator 130 is effective is determined primarily by the length of the horizontal section and height of the isolator 130. The horizontal section is generally parallel to the ground plane 112 in this illustrated embodiment.

As shown in FIGS. 2, 6, 7, and 9, the ground plane 112 includes an integrally formed (e.g., stamped and bent tabs 124, etc.) feature 124 for soldering a cable braid 126. This feature provides minimum (or at least reduced) direct galvanic contact surface between the cable braid 126 and the ground plane 112 as only the cross section of the integrally formed feature contacts the ground plane 112. Advantageously, this helps to prevent (or at least reduce) any inconsistency in the contact between the cable braid 126 and the ground plane 112. In this exemplary embodiment, the ground plane 112 includes first and second pairs of stamped and bent tabs 124 that are at an acute angle (e.g., 30 degrees, etc.) relative to the ground plane 112. By way of example, each tab 124 may be at about 30 degrees relative to the ground plane 112 such that each of the first and second pairs of tabs 124 defines an angle therebetween of about 60 degrees. FIG. 9 shows the solder joints 125 and cable braid 126 soldered to the integral cable holder 124 of the ground plane 112. In FIG. 9, there is no contact along the bottom 127 of the cable braid 126, which is hollow or open due to the stamping and repositioning of ground plane material to make the cable holder 124. By comparison, FIG. 8 illustrates a conventional way for soldering a coaxial cable braid 126 to a ground plane, which may introduce inconsistent contact especially along the bottom 127 of the cable braid 126 where there is no solder between the cable braid 126 and ground plane.

With reference to FIGS. 6, 7, 11, 13, and 14, the center conductor 131 of a coaxial cable 137 may be connected (e.g., soldered, etc.) to the antenna 110 and the center conductor or contact 120 of the connector 114. From underneath, the connector 114 may be positioned so that the connector's center contact 120 passes through a hole in a tab 140 of the antenna 110 (FIGS. 11 and 13). From above, the center conductor 131 of the coaxial cable 137 may be placed on the tab 140 in physical galvanic contact with or close proximity to the connector's center conductor 120, and then soldered together.

To allow access for soldering purposes, a portion 142 of the antenna 110 may be removed (e.g., cut, etc.) as shown in FIGS. 13 and 14. The antenna 110 also includes a tab 144 that is small and/or reduced in size to minimize (or at least reduce) PIM issues and inconsistency that may arise from soldering.

The antenna system 100 is also configured so as to have relatively small areas for soldering the outer contacts 122 of the connector 114 to the ground plane 112. As shown in FIG. 13, there are four relatively small soldering areas for soldering the contacts 122 of the connector 114 (FIG. 10A) to the ground plane 112. As shown in FIG. 16, the ground plane 112 includes openings 117 to allow the connector's center contact 120 and four outer contacts 122 to pass therethrough. The small soldering areas also help to provide a low PIM design.

FIGS. 10A through 12C illustrate an exemplary embodiment of a connector 114 that may be used with the antenna system 100. As shown, the connector 114 includes the center contact or pin 120 and four outer contacts or pins 122. The connector 114 also includes a nut 146, a lock washer 148, and an O-ring 150.

Advantageously, the connector 114 is designed so as to have a small soldering pin to reduce the soldering area, and thereby reduce PIM. The base material of the connector shell is a non-ferromagnetic material, such as Trimetal or albaloy. The pins or contacts are also made of non-ferromagnetic material, such as beryllium copper. By using non-ferromagnetic materials, the antenna system will have a better or lower PIM performance.

In one specific example, the connector body/shell plating is brass with an albaloy finish. The contacts 120, 122 are beryllium copper with gold finish. The O-ring 150 is silicon rubber. The lock washer 148 and nut 146 are brass with albaloy/copper finish. In this specific example, the connector 114 also has an impedance of 50 ohms, a frequency range of 0 to 6 GHz, a maximum VSWR of 1.2 over the frequency range, and an operating temperature of −55° C. to +125° C. The specific materials, dimensions, and technical data are provided only for purposes of illustration and not for purposes of limitation. Alternative embodiments may include connectors that are configured differently, e.g., made from difference materials, different sizes, different technical data, etc.

Figure 2:
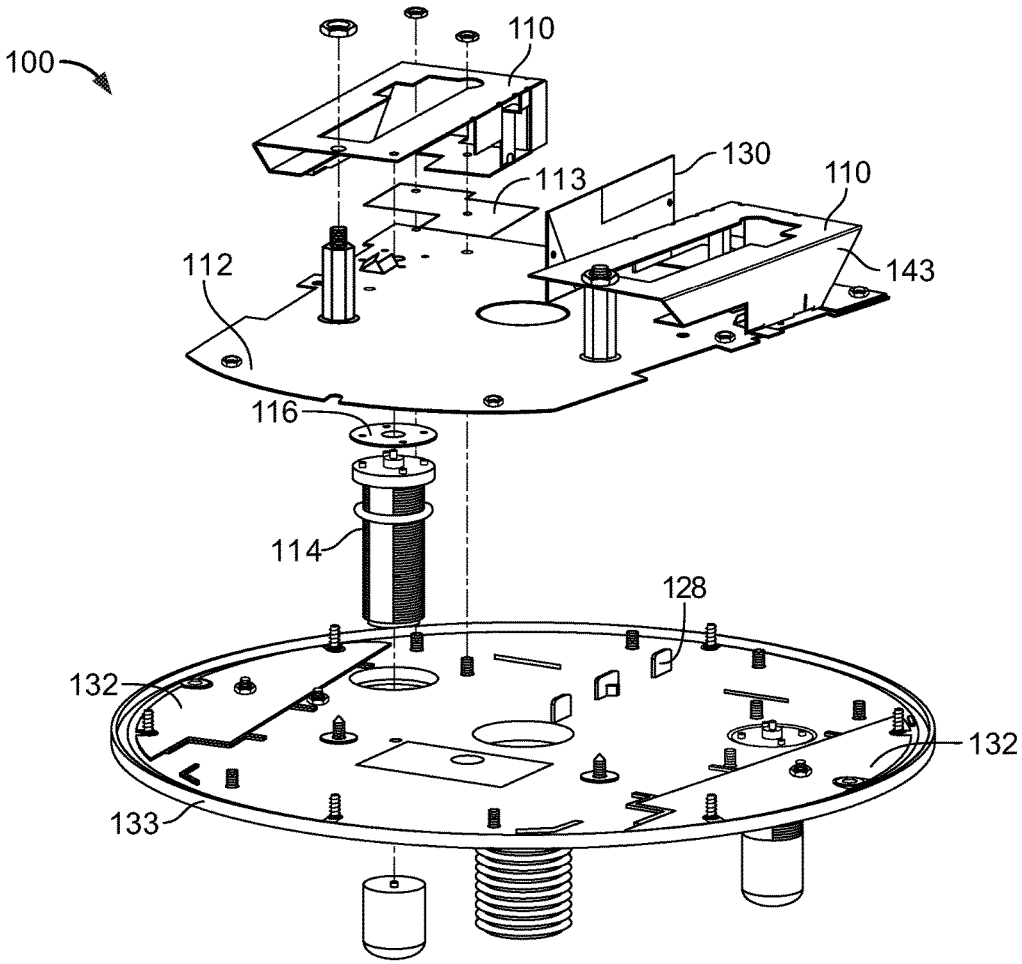
FIG. 2 is a exploded perspective view of a multi-band antenna system configured to have low PIM (passive intermodulation) according to an exemplary embodiment.
Figure 10B:
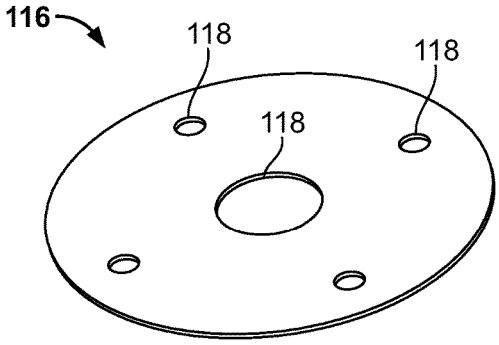

As shown in FIG. 2, a dielectric member or insulator 116 is positioned between an upper surface of the connector 114 and the ground plane 112 to electrically insulate and minimize (or at least reduce) direct galvanic contact between the connector's upper surface and the ground plane 112. In this exemplary embodiment, the insulator 116 is circular and made of FR-4 fiberglass reinforced epoxy laminate material. As shown in FIG. 10B, the insulator 116 includes openings 118 to allow the connector's center contact 120 and four outer contacts 122 to pass therethrough for electrical connection (e.g., soldering, etc.) to the antenna 110 and ground plane 112, respectively. Alternative embodiments may include a differently configured insulator, e.g., non-circular and/or made of a different material, etc.

The configuration of the ground plane 112 may depend, at least in part, on the particular end use intended for the antenna system 100. Thus, the particular shape, size, and material(s) (e.g., brass, other non-ferromagnetic material, etc.) of the ground plane 112 may be varied or tailored to meet different operational, functional and/or physical requirements. But in view of the relatively small lower surfaces of the antennas 110, the ground plane 112 is configured to be sufficiently large enough to be a fully effective ground plane for the antenna system 100.

In the illustrated embodiment of FIG. 16, the ground plane 112 has a trapezoidal portion and a rounded portion. The ground plane 112 may be sized or trimmed so as to fit onto a relatively small radome base (e.g., base 233 in FIG. 18C, base 333 in FIG. 19A, etc.) and so as to fit under a radome or housing (e.g., radome 235 in FIG. 18A, radome 335 in FIG. 19A, etc.). Alternative embodiments may include differently configured ground planes having other shapes, such as the shape shown in FIG. 11, non-trapezoidal shapes, non-rectangular shapes, entirely rectangular shapes, entirely trapezoidal shapes, etc.

With ground planes, the length may be increased or maximized to increase bandwidth. As noted above, however, the ground plane 112 may be sized small enough so that it may be confined within a relatively small radome assembly. For example, an exemplary embodiment may include the ground plane 112 being configured (e.g., shaped and sized) so as to be mounted on the circular radome base 233 (shown in FIG. 18C) having a diameter of about 219 millimeters or less.

Figure 4:
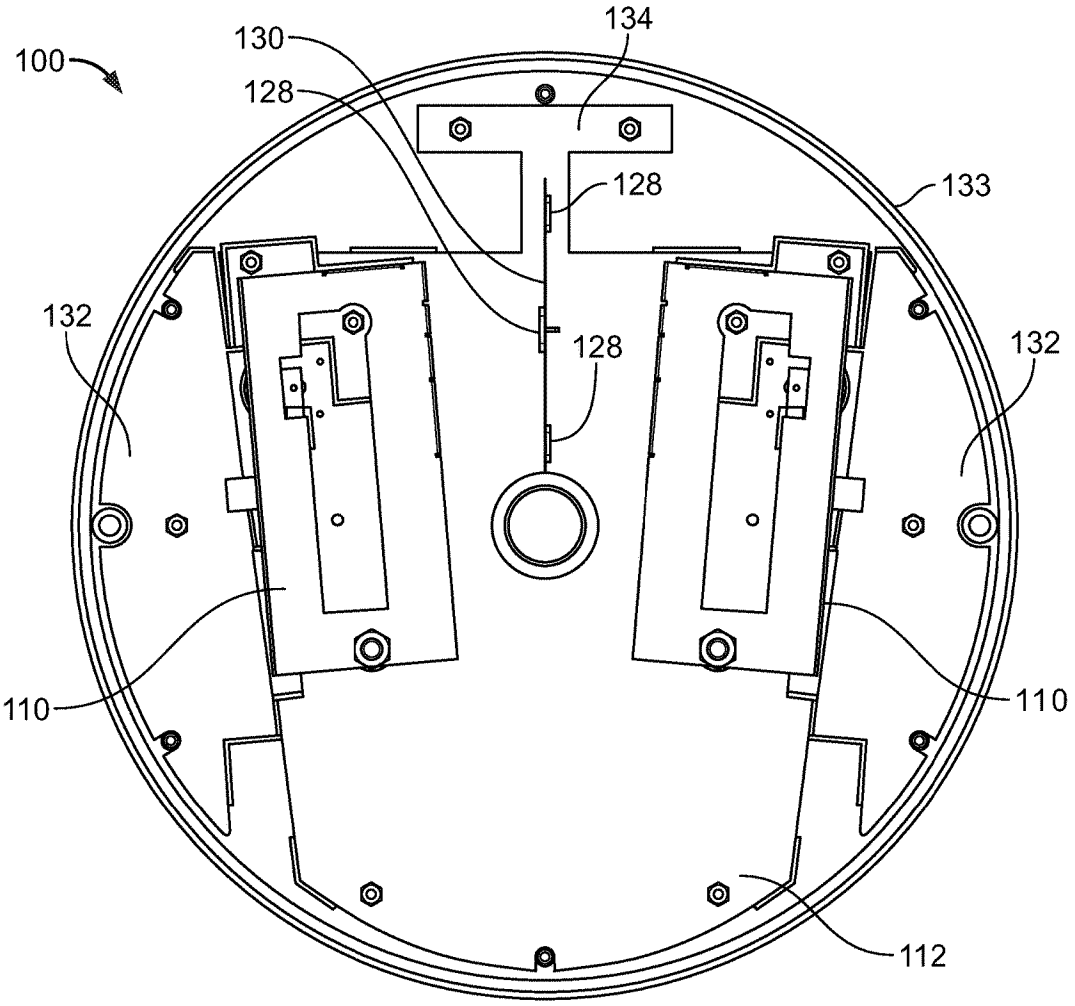
FIG. 4 is a plan view of the antenna system shown in FIGS. 2 and 3 after the various antenna components have been assembled on and/or mounted to the base.

A small ground plane may not have sufficient electrical length for some end use applications. As shown in FIG. 4, the ground plane 112 includes a T-shaped extension or isolator 134. The isolator 134 serves the purpose of bandwidth enhancement by increasing the electrical length of the ground plane 112 and improving isolation.

With reference to FIG. 14, the driven radiating section of the antenna 110 includes a radiating patch element 138 (or more broadly, an upper radiating surface or planar radiator). The radiating patch element 138 includes a slot 139 for forming multiple frequencies (e.g., frequencies from 698 megahertz to 960 megahertz and from 1710 megahertz to 2700 megahertz, etc.) and for frequency tuning at the high band. The slot 139 may be configured such that the antenna 110 improves the return loss level at high frequencies or high frequency bands for a higher patch. For a lower profile patch option, a slot may not be needed to improve high band in other embodiments. In this illustrated example embodiment, the slot 139 is generally rectangular (except for the removed portion 142) and divides the radiating patch element 138 so as to configure the antenna 110 to be resonant or operable in at least a first frequency range and a second frequency range, which is different (e.g., non-overlapping, disjoint, higher, etc.) than the first frequency range. For example, the first frequency range may be from about 698 megahertz to about 960 megahertz, while the second frequency range may be from about 1710 megahertz to about 2700 megahertz. Or, for example, the antenna 110 may be operable across a single wide frequency range from about 698 MHz to about 2700 MHz. The slot 139 may be configured for different frequency ranges and/or have any other suitable shape, for example a line, a curve, a wavy line, a meandering line, multiple intersecting lines, and/or non-linear shapes, etc., without departing from the scope of this disclosure. The slot 139 is an absence of electrically-conductive material in the radiating patch element 138. For example, the radiating patch element 138 may be initially formed with the slot 139, or the slot 139 may be formed by removing electrically-conductive material from the radiating patch element 138, such as etching, cutting, stamping, etc. In still yet other embodiments, the slot 139 may be formed by an electrically nonconductive or dielectric material, which is added to the upper radiating patch element 138 such as by printing, etc.

The radiating patch element 138 is spaced apart from and disposed above a lower surface 141 of the antenna 110. By way of example only, the radiating patch element 138 may include a top surface that is about 20 millimeters above the bottom of the lower surface. This dimension and all other dimensions provided herein are for purposes of illustration only, as other embodiments may be sized differently.

In this example, the radiating patch element 138 and lower surface 141 are generally parallel to each other and are also planar or flat. Alternative embodiments may include different configurations, such as non-planar, non-flat, and/or non-parallel radiating elements and lower surfaces.

Figure 7:
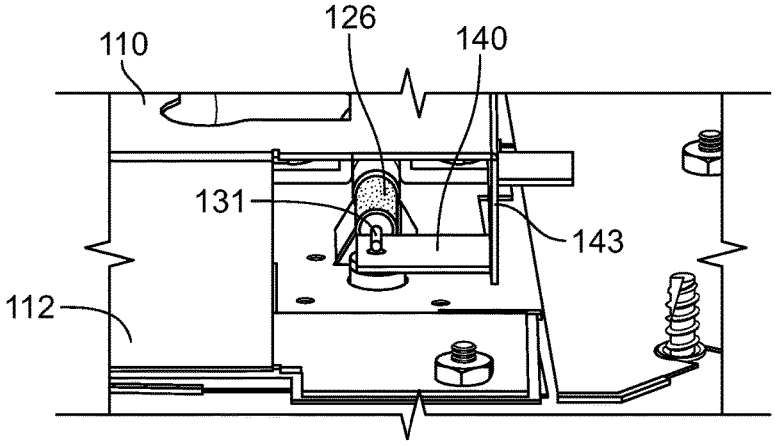
FIG. 7 is another partial perspective view of the coaxial cable and antenna shown in FIGS. 5 and 6, and illustrating the exemplary way that the center conductor of the coaxial cable may be connected to the antenna.

The antenna 110 includes a feeding element 143 (FIGS. 2, 3, and 7). The tab 140 (FIG. 7) along the bottom of the feeding element 143 provides or is operable as the feeding point. The center conductor 131 of the coaxial cable 137 and center contact 120 of the connector 114 may be electrically connected, e.g., soldered, to each other and to the tab 140 for feeding the antenna 110.

In operation, the feeding points of the antennas 110 may receive signals to be radiated by the radiating patch elements 138 from the coaxial cables 137, which signals may be received by the coaxial cables 137 from a transceiver, etc. Conversely, the coaxial cables 137 may receive signals from the feeding points of the antennas 110 that were received by the radiating patch elements 138. Alternative embodiments may include other feeding arrangements or means for feeding the antennas 110 besides coaxial cables, such as transmission lines, etc.

With reference to FIG. 3, the feeding element 143 is electrically connected to and extends between the radiating patch element 138 and the lower surface 141. The feeding element 143 is relatively wide as the feeding element 143 may be defined or considered as being the entire illustrated side of the antenna 110 between the radiating patch element 138 and lower surface 141. In this exemplary embodiment, the feeding element 143 is electrically connected to and extends between the edges of the radiating patch element 138 and lower surface 141. In other embodiments, however, the feeding element may be electrically connected to the radiating patch element and/or lower surface of the antenna at a location inwardly spaced from an edge.

Also shown in FIG. 3, the feeding element 143 includes tapering or inwardly slanted features 145 along opposite side portions of the feeding element 143. The feeding element 143 with the tapering features 145 may be configured for impedance matching purposes that broaden antenna bandwidth, such that the antenna 110 is operable in at least two frequency bands.

In this illustrated embodiment, the tapering features 145 comprise side edge portions of the feeding element 143 that are slanted or angled inwardly towards the middle of feeding element 143. Stated differently, the side edge portions 145 of the feeding element 143 are slanted or angled inwardly toward each other along these edge portions in a direction from the radiating patch element 138 downward towards the lower surface 141. Accordingly, the upper portion of the feeding element 143 adjacent and connected to the radiating patch element 138 decreases in width due to the tapering features or inwardly angled upper side edge portions 145. In alternative embodiments, the feeding elements 143 may include only one or no tapering features.

The lower surface 141 of the antenna 110 may also be considered a ground plane. But depending on the particular end use, the size of the lower surface 141 may be relatively small and of insufficient size for providing a fully effective ground plane. In such embodiments, the lower surface 141 may be used mostly for mechanically attaching the antenna 110 to a base 133, which, in turn, is coupled to a sufficiently large enough ground plane.

The antenna 110 also includes first and second shorting elements 160, 162. The first and second shorting elements 160, 162 electrically connect and extend between the radiating patch element 138 and the lower surface 141. In this exemplary embodiment, the first and second shorting elements 160, 162 are electrically connected along the edges of the radiating patch element 138 and lower surface 141. In other embodiments, however, the first and/or second shorting element 160, 162 may be electrically connected to the radiating patch element 138 and/or lower surface 141 at a location inwardly spaced from an edge. In addition, the first and second shorting elements 160, 162 may also help mechanically support the radiating patch element 138 above the lower surface 141 of the antenna 110.

The first shorting element 160 may be configured or formed to provide basic antenna operations or functions. For example, the first shorting element 160 may be configured or formed to allow a smaller radiating patch element 138 to be used, e.g., smaller than one-half wavelength patch antenna. By way of example, the radiating patch 138 may be sized such that the sum of its length and width is about one-fourth wavelength (¼λ) of a desired resonant frequency.

The second shorting element 162 may be configured or formed to enhance or improve bandwidth of the antenna 110 at a first, low frequency range or bandwidth (e.g., frequencies from 698 megahertz to 960 megahertz, etc.). Thus, the second shorting element 162 may allow a smaller patch to be used by broadening the bandwidth. Accordingly, this exemplary antenna 110 includes double shorting (via the elements 160, 162) and a radiating element 138 with a slot 139 to excite multiple frequencies while enhancing the bandwidth of the antenna 110.

In this exemplary embodiment, the first shorting element 160 is generally flat or planar, rectangular, and perpendicular to the upper radiating patch element 138 and lower surface 141. Alternative embodiments may include a first shorting element configured differently, such as a non-flat shorting and/or a shorting that is non-perpendicular to the upper radiating patch element 138 and/or lower surface 141.

Also in this exemplary embodiment, the second shorting element 162 is configured such that it has an overall length greater than the spaced distance or gap separating the radiating patch element 138 and the lower surface 141. In this example, the second shorting element 162 has a non-planar or non-flat configuration. As shown in FIG. 14, the second shorting element 162 includes a first or lower portion 164 that is flat or planar. The first portion 164 is adjacent and perpendicular to the lower surface 141 of the antenna 110. The second shorting element 162 also includes a second or upper portion 166 adjacent and connected to the radiating patch element 138. The second portion 166 is not co-planar with and protrudes or extends outwardly relative to the first portion 164, thus providing the second shorting element 162 with a three-dimensional, non-flat or non-planar configuration.

By way of example, the second portion 166 may comprise a bent portion, staircase-shaped portion, portion having a step configuration, etc. Differently-shaped first and/or second shorting elements may be disposed between a radiating patch element and a lower surface of an antenna in alternative embodiments. For example, the second shorting element 162 may have a flat configuration when viewed from the side. A second shorting element may be perpendicular to the upper and lower surfaces of the antenna 110, where this second shorting element 162 may have a meandering or non-linear configuration when viewed from the front or back such that its length is greater than the spaced distance or gap separating the antenna's upper and lower surfaces. A second shorting element may be non-perpendicular to the upper and lower surfaces of the antenna 110, where the second shorting element 162 has a length greater than the spaced distance or gap separating the antenna's upper and lower surfaces. The first and second shorting elements 160, 162 should not be limited to only the particular shapes illustrated in the figures.

FIG. 3 illustrates a capacitive loading element 170 of the antenna 110 configured or formed (e.g., bent or folded backwardly, etc.) to provide capacitive loading to widen the bandwidth of the antenna 110 at a second, high frequency range or bandwidth (e.g., frequencies from 1710 megahertz to 2700 megahertz, etc.). As shown in FIG. 3, the element 170 extends inwardly from the feeding element 143 and is disposed generally between the radiating patch element 138 and lower surface 141 of the antenna 110. Alternative embodiments may be configured differently (e.g., without the capacitive loading or bend back element, etc.) than what is illustrated in FIG. 3.

As shown in FIG. 14, the illustrated embodiment of the antenna 110 includes capacitive loading elements or stubs 172 on opposite sides of the second shorting element 162. These elements 172 are configured or formed so as to create capacitive loading for tuning the antenna 110 to one or more frequencies. For example, the elements 172 may be configured for tuning the antenna 110 to a first or low frequency range or bandwidth (e.g., frequencies from 698 megahertz to 960 megahertz, etc.) and to a second or high frequency or bandwidth (e.g., frequencies from 1710 megahertz to 2700 megahertz, etc.). Alternative embodiments may be configured differently (e.g., without the capacitive loading elements or stubs, etc.).

In exemplary embodiments, the antennas 110 may be integrally or monolithically formed from a single piece of electrically-conductive non-ferromagnetic material (e.g., brass, etc.) by stamping (e.g., via single stamping or progressive stamping technique, etc.) and then bending, folding, or otherwise forming the stamped piece of material. The antenna 110 may not include any dielectric (e.g., plastic) substrate that mechanically supports or suspends the upper radiating patch element 138 above the lower surface 141 or ground plane of the antenna 110. Instead, the upper radiating patch element 138 of the antenna 110 may be mechanically supported above the lower surface 141 by the antenna's shorting elements. Accordingly, the antenna 110 may be considered as having an air-filled substrate or air gap between the upper radiating patch element 138 and lower surface 141, which allows for cost savings due to the elimination of a dielectric substrate. Alternative embodiments may include a dielectric substrate that supports the upper radiating patch element above the ground plane or lower surface of the antenna and/or one or more components or elements that are not integrally formed, but which are separately attached to the antenna.

A wide range of materials may be used for the components of the antenna systems disclosed herein. By way of example, the antennas, isolators, and ground plane may all be made of brass or materials that are not ferromagnetic. In this example, there would preferably not be any ferromagnetic material or ferromagnetic components, which might otherwise be a source of PIM. The selection of the particular non-ferromagnetic material may depend on the suitability of the material for soldering, hardness, and costs.

FIGS. 18A through 18C illustrate an exemplary embodiment 200 that includes the antenna system 100 (FIGS. 2 through 5). A radome 235 is positioned over the antenna system 200 and coupled to the base 233. In this example shown in FIG. 18A, the base 233 has an outer diameter of about 219 millimeters (e.g., 218.7 millimeters+/−1 millimeter, etc.). The overall radome and base assembly (FIG. 18B) has an overall height of about 43.5 millimeters (e.g., 43.5 millimeters+/−1 millimeter, etc.). Also shown in FIG. 18B is a threaded portion protruding outwardly from the base 233. By way of example only, the threaded portion may have a length of about 50.8 millimeters and 1"-8 thread size. Pigtail type connectors 251 are also shown extending outwardly from within the threaded portion. The antenna system 200 may be mounted to a support surface (e.g., ceiling, etc.) by positioning the base 233 on one side of the support surface and positioning and threading a mounting nut 246 and locking washer or gasket 248 (e.g., a rubber locking gasket, etc.) onto the threaded portion on the opposite side of the support surface. In exemplary embodiments that include a rubber locking gasket, the rubber locking gasket may be removed and not used when the antenna system 200 is going to be installed to ceiling tile. Exemplary dimensions in this paragraph and all other dimensions herein are provided for purposes of illustration only, as alternative embodiments may be sized differently.

FIGS. 19A and 19B illustrate an exemplary embodiment 300 that also includes the antenna system 100 (FIGS. 2 through 5), where a radome 335 is positioned over the antenna system 300 and coupled to the base 333. But this exemplary embodiment 300 includes a fixed NF bulkhead connector instead of the pigtail type connection shown in FIG. 18B.

FIGS. 20 through 29 provide analysis results measured for a prototype 200 shown in FIGS. 18A, 18B, and 18C. The prototype 200 included the antenna system 100 (FIGS. 2 through 5), which was positioned within a radome and configured with a pigtail type connection. These analysis results are provided only for purposes of illustration and not for purposes of limitation.

More specifically, FIG. 20 includes exemplary line graphs of Voltage Standing Wave Ratio (VSWR) (S11, S22) and isolation (S21 in decibels) versus frequency measured for the prototype antenna system 200. Generally, FIG. 20 shows that the prototype antenna system 200 is operable with good voltage standing wave ratios (VSWR) and with relatively good isolation between the two antennas 110.

FIGS. 22 through 29 illustrate radiation patterns (azimuth plane, Phi 0° plane, and Phi 90° plane) measured for the first and second multi-band antennas 110 (shown in broken lines and solid lines) of the prototype antenna system 200 with the pigtail type connection and pattern orientation shown in FIG. 21 at frequencies of about 698 megahertz (MHz), 824 MHz, 894 MHz, 960 MHz, 1785 MHz, 1910 MHz, 2110 MHz, and 2700 MHz, respectively. Generally, FIGS. 22 through 29 show the quasi-omnidirectional radiation pattern (low profile antenna radiation pattern) and good efficiency of the antenna system 200. Accordingly, the antenna system 200 has a large bandwidth that allows multiple operating bands for wireless communications devices, including FDD and TDD LTE frequencies or frequency bands. In addition, the antenna system 200 of this exemplary embodiment has vertical or horizontal polarization like a conventional PIFA antenna (e.g., PIFA 10 shown in FIG. 1, etc.).

FIGS. 30 and 31 are exemplary line graphs of passive intermodulation (PIM) versus frequency measured for ports 1 and 2 of the prototype antenna system 200 with the pigtail type connection (FIG. 18B). As shown, the antenna system 200 has low PIM performance (e.g., less than −150 dBc, etc.) at both a low band (FIG. 30) and a high band (FIG. 31). For example, the antenna system 200 may preferably have a low PIM of −153 dBc or less at low and high bands.

Immediately below are tables 1 and 2 with performance summary data measured for the first and second antennas 110 (FIGS. 2 through 5) of the prototype antenna system 200 (FIG. 18B) with the pigtail type connection. As shown by the tables, the prototype antenna system 200 with the pigtail connection has good efficiency through the whole band with better efficiency at low band.

TABLE 1

(First Antenna with Pigtail Connection)

| | 3D | | Azimuth | | | Elevation 0° | | Elevation 90° | |
|---|---|---|---|---|---|---|---|---|---|
| Frequency (MHz) | Efficiency | Max Gain | Max Gain | Average Gain | Ripple | Max Gain | Average Gain | Max Gain | Average Gain |
| 698 | 76% | 1.92 | 0.72 | −1.68 | 5.96 | 0.97 | −0.72 | 0.81 | −1.02 |
| 750 | 89% | 1.87 | 1.42 | −0.93 | 5.52 | 1.87 | 0.08 | 1.41 | −0.38 |
| 800 | 87% | 2.56 | 1.36 | −0.98 | 5.94 | 2.24 | 0.00 | 1.88 | −0.84 |
| 824 | 80% | 2.58 | 1.53 | −1.20 | 6.69 | 2.30 | −0.34 | 1.86 | −1.28 |
| 849 | 79% | 3.25 | 1.98 | −1.05 | 8.89 | 2.59 | −0.64 | 1.71 | −1.56 |
| 869 | 78% | 3.58 | 2.21 | −0.95 | 9.74 | 3.07 | −0.74 | 1.72 | −1.88 |
| 880 | 74% | 3.54 | 2.19 | −1.15 | 10.39 | 3.16 | −0.95 | 1.55 | −2.26 |
| 894 | 74% | 3.93 | 2.67 | −1.11 | 11.53 | 3.81 | −0.86 | 1.18 | −2.63 |
| 915 | 74% | 4.61 | 2.83 | −1.08 | 13.56 | 4.48 | −0.82 | 1.02 | −3.17 |
| 925 | 77% | 4.88 | 2.92 | −0.88 | 14.17 | 4.68 | −0.68 | 1.31 | −3.14 |
| 960 | 78% | 4.40 | 3.00 | −0.71 | 12.66 | 4.18 | −0.58 | 1.37 | −3.27 |
| 1710 | 70% | 4.62 | 1.59 | −2.85 | 15.44 | 4.52 | −0.42 | 4.42 | 0.07 |
| 1785 | 76% | 5.33 | −0.23 | −3.33 | 9.92 | 5.20 | −0.02 | 4.66 | 0.11 |
| 1805 | 74% | 5.37 | −0.76 | −3.54 | 10.01 | 5.27 | −0.11 | 4.97 | −0.03 |
| 1850 | 68% | 4.88 | −0.83 | −3.41 | 10.57 | 4.88 | −0.54 | 3.99 | −0.86 |
| 1880 | 69% | 4.84 | −0.46 | −3.10 | 10.76 | 4.83 | −0.52 | 2.95 | −1.39 |
| 1910 | 69% | 4.34 | 0.28 | −2.99 | 11.26 | 4.34 | −0.80 | 2.11 | −1.93 |
| 1920 | 68% | 4.06 | 0.47 | −2.92 | 11.33 | 4.06 | −0.94 | 1.80 | −2.15 |
| 1930 | 67% | 3.83 | 0.48 | −2.84 | 11.33 | 3.83 | −1.07 | 1.45 | −2.37 |
| 1980 | 63% | 3.12 | 0.20 | −2.76 | 9.67 | 3.08 | −1.39 | 0.50 | −3.03 |
| 1990 | 63% | 3.01 | 0.34 | −2.75 | 9.61 | 2.96 | −1.44 | 0.47 | −3.04 |
| 2110 | 57% | 2.21 | −1.20 | −3.86 | 8.42 | 2.09 | −2.38 | 1.88 | −2.35 |
| 2170 | 62% | 3.35 | −0.89 | −3.66 | 8.72 | 3.10 | −1.78 | 2.25 | −1.92 |
| 2500 | 75% | 7.02 | −1.56 | −4.90 | 11.04 | 4.83 | −3.16 | 6.03 | 0.51 |
| 2600 | 72% | 7.17 | −1.83 | −5.26 | 15.97 | 4.21 | −3.30 | 6.02 | 0.42 |
| 2700 | 70% | 6.48 | −1.65 | −4.40 | 8.04 | 3.95 | −2.42 | 5.61 | 0.14 |

TABLE 2

(Second Antenna with Pigtail Connection)

| | 3D | | Azimuth | | | Elevation 0° | | Elevation 90° | |
|---|---|---|---|---|---|---|---|---|---|
| Frequency (MHz) | Efficiency | Max Gain | Max | Average Gain | Ripple | Max Gain | Average Gain | Max Gain | Average Gain |
| 698 | 77% | 1.81 | 1.67 | −1.23 | 8.16 | 1.58 | −0.25 | 1.03 | −1.01 |
| 750 | 89% | 2.11 | 2.04 | −0.58 | 7.64 | 1.88 | 0.38 | 1.53 | −0.49 |
| 800 | 87% | 2.36 | 1.87 | −0.65 | 8.69 | 2.13 | 0.24 | 1.83 | −1.05 |
| 824 | 81% | 2.42 | 1.86 | −0.83 | 8.96 | 1.94 | −0.06 | 1.68 | −1.48 |
| 849 | 79% | 2.90 | 2.31 | −0.68 | 10.96 | 2.10 | −0.35 | 1.13 | −1.73 |
| 869 | 77% | 3.02 | 2.74 | −0.60 | 13.16 | 2.06 | −0.47 | 0.93 | −2.08 |
| 880 | 73% | 3.15 | 2.96 | −0.81 | 14.07 | 2.29 | −0.52 | 0.44 | −2.41 |
| 894 | 74% | 3.49 | 3.32 | −0.75 | 16.11 | 2.58 | −0.38 | 0.29 | −2.68 |
| 915 | 75% | 4.00 | 3.86 | −0.63 | 18.31 | 2.86 | −0.42 | 0.10 | −3.12 |
| 925 | 78% | 4.23 | 4.06 | −0.46 | 18.40 | 3.06 | −0.36 | 0.24 | −3.08 |
| 960 | 79% | 4.31 | 4.03 | −0.54 | 15.76 | 2.77 | −0.31 | 1.04 | −3.12 |
| 1710 | 73% | 4.75 | 1.45 | −2.67 | 17.59 | 4.66 | −0.63 | 4.62 | 0.34 |
| 1785 | 76% | 5.28 | −1.58 | −3.40 | 6.98 | 5.07 | −0.25 | 4.83 | 0.36 |
| 1805 | 74% | 5.28 | −1.78 | −3.54 | 7.49 | 5.16 | −0.32 | 4.69 | 0.13 |
| 1850 | 68% | 4.69 | −1.20 | −3.38 | 8.49 | 4.63 | −0.75 | 3.88 | −0.73 |
| 1880 | 67% | 4.52 | −0.52 | −3.11 | 10.06 | 4.50 | −0.87 | 3.09 | −1.32 |
| 1910 | 68% | 4.06 | 0.49 | −2.66 | 10.84 | 4.05 | −0.95 | 2.25 | −1.89 |
| 1920 | 68% | 3.90 | 0.61 | −2.58 | 10.95 | 3.90 | −0.96 | 2.03 | −2.07 |
| 1930 | 68% | 3.79 | 0.70 | −2.53 | 11.26 | 3.79 | −0.99 | 1.89 | −2.21 |
| 1980 | 64% | 3.17 | 0.32 | −2.63 | 10.79 | 3.12 | −1.15 | 1.56 | −2.75 |
| 1990 | 64% | 3.10 | 0.38 | −2.57 | 10.43 | 3.05 | −1.16 | 1.60 | −2.73 |
| 2110 | 67% | 2.96 | −0.02 | −2.70 | 10.03 | 2.86 | −1.28 | 2.22 | −1.91 |
| 2170 | 61% | 3.27 | −0.65 | −3.46 | 9.23 | 2.57 | −2.20 | 2.54 | −1.86 |
| 2500 | 76% | 7.03 | −1.16 | −4.87 | 13.68 | 4.39 | −3.29 | 6.39 | 0.81 |

TABLE 2-continued (Second Antenna with Pigtail Connection)

| | 3D | | Azimuth | | | Elevation 0° | | Elevation 90° | |
|---|---|---|---|---|---|---|---|---|---|
| Frequency (MHz) | Efficiency | Max Gain | Max | Average Gain | Ripple | Max Gain | Average Gain | Max Gain | Average Gain |
| 2600 | 70% | 6.94 | −1.37 | −5.12 | 17.34 | 3.17 | −3.77 | 6.16 | 0.43 |
| 2700 | 73% | 6.55 | −1.38 | −3.98 | 8.69 | 2.96 | −2.93 | 5.96 | 0.37 |

FIGS. 32 through 42 provide analysis results measured for a prototype 300 shown in FIGS. 19A and 19B. The prototype 300 included the antenna system 100 (FIGS. 2 through 5), which was positioned within a radome and configured with a fixed NF bulkhead connector. These analysis results are provided only for purposes of illustration and not for purposes of limitation.

More specifically, FIG. 32 includes exemplary line graphs of Voltage Standing Wave Ratio (VSWR) (S11, S22) and isolation (S21 in decibels) versus frequency measured for the prototype antenna system 300. Generally, FIG. 32 shows that the prototype antenna system 300 is operable with good voltage standing wave ratios (VSWR) and with relatively good isolation between the two antennas 110.

FIGS. 33 through 40 illustrate radiation patterns (azimuth plane, Phi 0° plane, and Phi 90° plane) measured for the first and second multi-band antennas 110 (shown in solid lines and broken lines) of the prototype antenna system 300 with the fixed NF bulkhead connector (FIG. 19B) at frequencies of about 698 megahertz (MHz), 824 MHz, 894 MHz, 960 MHz, 1785 MHz, 1910 MHz, 2110 MHz, and 2700 MHz, respectively. The pattern orientation for this series of testing is the same as that shown in FIG. 21. Generally, FIGS. 33 through 40 show the quasi-omnidirectional radiation pattern (low profile antenna radiation pattern) and good efficiency of the antenna system 300. Accordingly, the antenna system 300 has a large bandwidth that allows multiple operating bands for wireless communications devices, including FDD and TDD LTE frequencies or frequency bands. In addition, the antenna system 300 of this exemplary embodiment has vertical or horizontal polarization like a conventional PIFA antenna (e.g., conventional PIFA 10 in FIG. 1, etc.).

FIGS. 41 and 42 are exemplary line graphs of passive intermodulation (PIM) versus frequency measured for ports 1 and 2 of the prototype antenna system 300 with the fixed NF bulkhead connector (FIG. 19B). As shown, the antenna system 300 has low PIM performance (e.g., less than −150 dBc, etc.) at both a low band (FIG. 41) and a high band (FIG. 42). For example, the antenna system 300 may preferably have a low PIM of −153 dBC or less at low and high bands.

Immediately below are tables 3 and 4 with performance summary data measured for the first and second antennas 110 (FIGS. 2 through 5) of the prototype antenna system 300 (FIG. 19B) with the fixed NF bulkhead connector. As shown, the prototype antenna system 300 with the fixed NF bulkhead connector has good efficiency through the whole band with better efficiency at low band.

TABLE 3

(First Antenna with fixed NF Bulkhead Connector)

| | 3D | | Azimuth | | | Elevation 0° | | Elevation 90° | |
|---|---|---|---|---|---|---|---|---|---|
| Frequency (MHz) | Efficiency | Max Gain | Max | Average Gain | Ripple | Max Gain | Average Gain | Max Gain | Average Gain |
| 698 | 84% | 2.54 | −0.36 | −2.55 | 16.72 | 2.40 | −0.21 | 2.52 | 0.34 |
| 750 | 91% | 2.68 | 0.54 | −1.87 | 15.76 | 2.46 | 0.35 | 2.59 | 0.47 |
| 800 | 91% | 3.50 | 0.00 | −1.95 | 10.09 | 3.32 | 0.39 | 3.49 | 0.20 |
| 824 | 85% | 3.50 | −0.14 | −2.17 | 10.21 | 3.36 | 0.04 | 3.48 | 0.01 |
| 849 | 83% | 2.83 | 0.59 | −1.94 | 10.73 | 2.27 | −0.12 | 2.75 | −0.13 |
| 869 | 84% | 2.21 | 1.03 | −1.82 | 11.91 | 2.10 | −0.12 | 2.15 | −0.26 |
| 880 | 80% | 2.11 | 0.82 | −2.06 | 12.21 | 2.11 | −0.29 | 2.11 | −0.51 |
| 894 | 80% | 2.43 | 1.20 | −2.09 | 13.40 | 2.42 | −0.23 | 2.43 | −0.57 |
| 915 | 81% | 2.54 | 1.38 | −2.01 | 13.70 | 2.54 | −0.31 | 2.51 | −0.41 |
| 925 | 86% | 2.75 | 1.59 | −1.64 | 13.70 | 2.74 | −0.28 | 2.68 | −0.12 |
| 960 | 87% | 3.43 | 3.06 | −0.93 | 13.78 | 2.49 | −0.47 | 2.86 | −0.11 |
| 1710 | 70% | 5.39 | −0.67 | −3.89 | 10.68 | 5.27 | 0.16 | 5.37 | 0.12 |
| 1785 | 79% | 5.71 | −1.46 | −3.06 | 6.42 | 5.57 | 0.30 | 5.13 | −0.13 |
| 1805 | 79% | 5.74 | −1.32 | −3.03 | 6.41 | 5.45 | 0.29 | 5.53 | −0.22 |
| 1850 | 70% | 5.33 | −0.78 | −3.40 | 8.19 | 5.29 | −0.13 | 5.12 | −0.90 |
| 1880 | 69% | 5.17 | −0.22 | −3.02 | 9.88 | 5.15 | −0.29 | 4.44 | −1.76 |
| 1910 | 69% | 4.40 | 0.58 | −2.63 | 11.72 | 4.39 | −0.57 | 3.74 | −2.18 |
| 1920 | 69% | 4.08 | 0.40 | −2.51 | 11.41 | 4.07 | −0.64 | 3.39 | −2.33 |
| 1930 | 69% | 3.90 | 0.43 | −2.33 | 10.98 | 3.85 | −0.67 | 2.96 | −2.55 |
| 1980 | 69% | 3.51 | 1.36 | −2.14 | 10.12 | 3.49 | −0.69 | 1.87 | −3.09 |
| 1990 | 68% | 3.46 | 1.32 | −2.22 | 10.51 | 3.44 | −0.78 | 1.75 | −3.16 |
| 2110 | 65% | 2.94 | 0.68 | −2.56 | 11.16 | 2.93 | −1.47 | 0.82 | −3.52 |
| 2170 | 69% | 3.56 | 1.13 | −2.64 | 13.70 | 3.32 | −1.25 | 1.91 | −2.54 |
| 2500 | 73% | 5.81 | 0.44 | −3.50 | 17.60 | 3.13 | −2.74 | 5.48 | 0.47 |
| 2600 | 71% | 6.15 | 1.08 | −3.17 | 13.94 | 1.47 | −3.62 | 5.61 | −0.13 |
| 2700 | 71% | 5.99 | 0.85 | −2.74 | 10.99 | 2.62 | −3.02 | 4.70 | −0.48 |

TABLE 4

(Second Antenna with fixed NF Bulkhead Connector)

| | 3D | | Azimuth | | | Elevation 0° | | Elevation 90° | |
|---|---|---|---|---|---|---|---|---|---|
| Frequency (MHz) | Efficiency | Max Gain | Max | Average Gain | Ripple | Max Gain | Average Gain | Max Gain | Average Gain |
| 698 | 83% | 2.26 | −0.47 | −2.71 | 10.89 | 2.23 | −0.37 | 2.24 | 0.30 |
| 750 | 93% | 2.96 | 0.52 | −1.95 | 11.07 | 2.53 | 0.23 | 2.83 | 0.43 |
| 800 | 93% | 3.40 | 0.18 | −1.81 | 9.00 | 3.20 | 0.09 | 3.40 | 0.24 |
| 824 | 87% | 3.17 | 0.34 | −2.02 | 9.85 | 3.10 | −0.20 | 3.16 | 0.06 |
| 849 | 87% | 2.50 | 0.78 | −1.87 | 10.74 | 2.09 | −0.27 | 2.45 | −0.11 |
| 869 | 85% | 2.16 | 0.75 | −1.90 | 10.97 | 1.18 | −0.31 | 2.10 | −0.34 |
| 880 | 82% | 1.70 | 0.62 | −2.18 | 11.84 | 1.52 | −0.36 | 1.51 | −0.55 |
| 894 | 82% | 1.97 | 1.13 | −2.16 | 12.09 | 1.74 | −0.30 | 1.48 | −0.68 |
| 915 | 83% | 2.25 | 1.40 | −1.97 | 13.57 | 1.87 | −0.46 | 1.37 | −0.65 |
| 925 | 89% | 2.66 | 1.68 | −1.58 | 14.18 | 2.33 | −0.34 | 2.05 | −0.36 |
| 960 | 91% | 3.44 | 2.57 | −1.07 | 14.28 | 2.88 | −0.36 | 2.94 | −0.31 |
| 1710 | 73% | 5.33 | 0.52 | −3.63 | 12.47 | 5.13 | 0.32 | 5.25 | 0.31 |
| 1785 | 79% | 5.59 | −0.67 | −2.86 | 6.80 | 5.46 | 0.14 | 5.11 | −0.12 |
| 1805 | 79% | 5.68 | −0.15 | −2.77 | 7.27 | 5.57 | 0.12 | 5.07 | −0.29 |
| 1850 | 68% | 5.32 | 0.13 | −2.87 | 9.74 | 4.96 | −0.59 | 4.30 | −1.36 |
| 1880 | 60% | 4.42 | 0.16 | −2.75 | 11.07 | 4.18 | −1.01 | 3.65 | −2.11 |
| 1910 | 66% | 4.33 | 0.97 | −2.46 | 14.67 | 4.16 | −0.65 | 3.72 | −1.95 |
| 1920 | 68% | 4.21 | 1.21 | −2.28 | 15.27 | 4.06 | −0.60 | 3.39 | −1.99 |
| 1930 | 70% | 4.18 | 0.99 | −2.13 | 13.04 | 4.03 | −0.53 | 3.06 | −2.01 |
| 1980 | 73% | 4.07 | 1.49 | −2.16 | 12.07 | 4.07 | −0.31 | 3.36 | −2.17 |
| 1990 | 73% | 4.09 | 1.61 | −2.11 | 11.94 | 4.09 | −0.35 | 3.33 | −2.18 |
| 2110 | 70% | 3.16 | 1.42 | −2.29 | 12.74 | 2.92 | −1.17 | 2.29 | −2.90 |
| 2170 | 71% | 3.89 | 1.08 | −2.34 | 14.62 | 3.69 | −1.42 | 2.21 | −2.22 |
| 2500 | 75% | 6.07 | −0.34 | −3.77 | 18.20 | 3.79 | −2.69 | 5.48 | 0.68 |
| 2600 | 72% | 6.26 | 1.07 | −3.13 | 15.42 | 2.34 | −3.24 | 5.39 | −0.18 |
| 2700 | 74% | 6.26 | 1.18 | −2.60 | 10.73 | 3.25 | −2.54 | 4.74 | −0.41 |

Exemplary embodiments of the antenna systems disclosed herein allow multiple operating bands for wireless communications devices. By way of example, an antenna system as disclosed herein may be configured to be operable or cover FDD (Frequency Division Duplex) and TDD (Time Division Duplex) LTE (Long Term Evolution) frequency bands (Table 5 below) as defined by 3GPP ($3^{rd}$ Generation Partnership Project). By way of background, different frequency bands are used to send and receive operations with the FDD technique so that sending and receiving data signals don't interfere with each other. By comparison, the TDD technique allocates different time slots in the same frequency band to separate uplink from downlink.

TABLE 5

| Band | Uplinks MHz | Downlink MHz | |
|---|---|---|---|
| 1 | 1920-1980 | 2110-2170 | FDD |
| 2 | 1850-1910 | 1930-1990 | FDD |
| 3 | 1710-1785 | 1805-1880 | FDD |
| 4 | 1710-1755 | 2110-2155 | FDD |
| 5 | 824-849 | 869-894 | FDD |
| 6 | 830-840 | 875-885 | FDD |
| 7 | 2500-2570 | 2620-2690 | FDD |
| 8 | 880-915 | 925-960 | FDD |
| 9 | 1749-1784 | 1844-1879 | FDD |
| 10 | 1710-1770 | 2110-2170 | FDD |
| 11 | 1427-1452 | 1475-1500 | FDD |
| 12 | 698-716 | 728-746 | FDD |
| 13 | 777-787 | 746-756 | FDD |
| 14 | 788-798 | 758-768 | FDD |
| 17 | 704-716 | 734-746 | FDD |
| 18 | 815-830 | 860-875 | FDD |
| 19 | 830-845 | 875-890 | FDD |
| 20 | 832-862 | 791-821 | FDD |
| 21 | 1448-1463 | 1496-1511 | FDD |
| 33 | 1900-1920 | 1900-1920 | TDD |
| 34 | 2010-2025 | 2010-2025 | TDD |
| 35 | 1850-1910 | 1850-1910 | TDD |

TABLE 5-continued

| Band | Uplinks MHz | Downlink MHz | |
|---|---|---|---|
| 36 | 1930-1990 | 1930-1990 | TDD |
| 37 | 1910-1930 | 1910-1930 | TDD |
| 38 | 2570-2620 | 2570-2620 | TDD |
| 39 | 1880-1920 | 1880-1920 | TDD |
| 40 | 2300-2400 | 2300-2400 | TDD |

Figure 1:
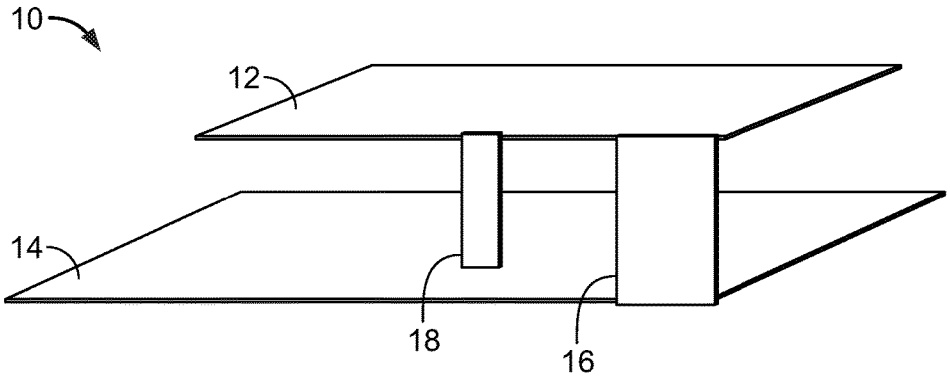
FIG. 1 (Prior Art)
FIG. 1 illustrates a conventional Planar Inverted-F Antenna (antenna)

In exemplary embodiments, an antenna system that includes one or more multi-band antennas (e.g., antenna with double shorting and modified from the PIFA antenna shown in FIG. 1, a modified PIFA with double shorting, etc.) may be operable for covering all of the above-listed frequency bands with good voltage standing wave ratios (VSWR) and with relatively good efficiency. Alternative embodiments may include an antenna system operable at less than or more than all of the above-identified frequencies and/or be operable at different frequencies than the above-identified frequencies.

Exemplary embodiments of the antenna systems (e.g., 100, 200, 300, etc.) disclosed herein are suitable for a wide range of applications, e.g., that use more than one antenna, such as LTE/4G applications and/or infrastructure antenna systems (e.g., customer premises equipment (CPE), satellite navigation systems, alarm systems, terminal stations, central stations, in-building antenna systems, etc.). An antenna system (e.g., 100, 200, 300, etc.) may be configured for use as an omnidirectional MIMO antenna, although aspects of the present disclosure are not limited solely to omnidirectional and/or MIMO antennas. An antenna system (e.g., 100, 200, 300, etc.) disclosed herein may be implemented inside an electronic device, such as machine to machine, vehicular, in-building unit, etc. In which case, the internal antenna components would typically be internal to and covered by the electronic device housing. As another example, the antenna system may instead be housed within a radome, which may have a low profile. In this latter case, the internal antenna components would be housed within and covered by the radome. Accordingly, the antenna systems disclosed herein should not be limited to any one particular end use.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances (e.g., angle+/−30', 0-place decimal+/−0.5, 1-place decimal+/−0.25, 2-place decimal+/−0.13, etc.). Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna system configured to be operable with low passive intermodulation, the antenna system comprising:

a base;

a ground plane mounted to the base and including integrally formed tabs to which are solderable cable braids;

first and second antennas;

a first isolator disposed between the first and second antennas;

a second isolator extending outwardly from the ground plane and separate from the first isolator;

wherein the ground plane and/or the base includes one or more integrally formed features for holding the first isolator generally perpendicular to the ground plane;

wherein the integrally formed tabs of the ground plane comprise tabs directly formed from material of the ground plane material that is repositioned at an acute angle relative to the ground plane, whereby there is no galvanic contact along a bottom of the cable braids to the ground plane and/or whereby an area underneath the bottom of the cable braids is open or hollow due to the repositioning of the ground plane material to make the tabs.

2. The antenna system of claim 1, wherein the second isolator is co-planar with the ground plane, and wherein:

the antenna system is operable within at least a first frequency range from about 698 megahertz to about 960 megahertz and a second frequency range from about 1710 megahertz to about 2700 megahertz; or the antenna system is operable within a frequency range from about 698 megahertz to about 2700 megahertz.

3. The antenna system of claim 1, wherein the antenna system is operable with a passive intermodulation less than −150 decibels relative to carrier for frequencies from about 698 megahertz to about 960 megahertz and from about 1710 megahertz to about 2700 megahertz, and wherein the second isolator is co-planar with the ground plane.

4. The antenna system of claim 1, wherein the ground plane, the first and second isolators, and the first and second antennas are made of non-ferromagnetic material, and wherein at least a portion of the first isolator is vertically disposed over and overlaps at least a portion of the second isolator.

5. The antenna system of claim 1, wherein the cable braids are soldered to the integrally formed tabs of the ground plane without using solder along the bottom of the cable braids between the ground plane and the bottom of the cable braids, whereby the area underneath the bottom of the cable braids is open or hollow.

6. The antenna system of claim 1, further comprising:

first and second connectors each having at least one center contact soldered to and thereby electrically connected to the corresponding first or second antenna and a plurality of outer contacts soldered to and thereby electrically connected to the ground plane; and first and second electrical insulators positioned between upper surfaces of the respective first and second connectors and the ground plane to electrically insulate and reduce galvanic contact area between the upper surfaces of the first and second connectors and the ground plane, to thereby reduce passive intermodulation;

wherein the ground plane and each of the first and second electrical insulators comprise a plurality of openings therethrough to allow the center contact and the plurality of outer contacts of a corresponding one of the first and second connectors to pass therethrough and be soldered to and thereby electrically connected to the respective first and second antennas and the ground plane on an opposite side of the ground plane without direct galvanic contact between the upper surfaces of the first and second connectors and the ground plane.

7. The antenna system of claim 1, wherein the second isolator is co-planar with the ground plane, and wherein at least a portion of the first isolator is vertically disposed over and overlaps at least a portion of the second isolator.

8. The antenna system of claim 1, wherein the base includes the integrally formed features for holding the first isolator generally perpendicular to the ground plane, wherein the first and second antennas are coupled to the base, and wherein the integrally formed features comprise portions protruding outwardly from the base that pass through openings in the ground plane, where the portions cooperate to frictionally retain the first isolator therebetween.

9. The antenna system of claim 1, wherein the ground plane includes the integrally formed features for holding the first isolator generally perpendicular to the ground plane, wherein the integrally formed features comprise first and second tabs stamped from the ground plane and bent generally perpendicularly to the ground plane, the first isolator comprises a vertical wall PCB isolator having first and second opposite sides, the vertical wall PCB isolator is positioned relative to the first and second tabs such that the first tab is along the first side of the vertical wall PCB isolator and the second tab is along the second side of the vertical wall PCB isolator, whereby the first and second tabs cooperate to frictionally retain the vertical wall PCB isolator therebetween.

10. The antenna system of claim 1, wherein:

at least a portion of the first isolator is vertically disposed over and overlaps at least a portion of the second isolator; and the second isolator comprises a generally T-shaped extension of the ground plane generally between the first and second antennas and co-planar with the ground plane, whereby the generally T-shaped extension increases the ground surface electrically which improves isolation at low band.

11. The antenna system of claim 1, further comprising:

dielectric adhesive tape disposed between the ground plane and the first and second antennas, to thereby inhibit direct galvanic contact between the first and second antennas and the ground plane, such that radiating element grounding is based on proximity couple grounding; and first and second parasitic elements adjacent the respective first and second antennas for enhancing bandwidth, wherein the first and second parasitic elements do not make direct galvanic contact with the first and second antennas and the first and second parasitic elements are parallel to the ground plane.

12. An antenna system configured to be operable with low passive intermodulation, the antenna system comprising:

a base;

a ground plane mounted to the base and including integrally formed tabs to which are solderable cable braids;

first and second antennas;

a first isolator disposed between the first and second antennas;

a second isolator extending outwardly from the ground plane and separate from the first isolator;

first and second connectors each having at least one center contact soldered to and thereby electrically connected to the corresponding first or second antenna and a plurality of outer contacts soldered to and thereby electrically connected to the ground plane; and first and second electrical insulators positioned between upper surfaces of the respective first and second connectors and the ground plane to electrically insulate and reduce galvanic contact area between the upper surfaces of the first and second connectors and the ground plane, to thereby reduce passive intermodulation;

wherein the ground plane and/or the base includes one or more integrally formed features for holding the first isolator generally perpendicular to the ground plane;

wherein the ground plane and each of the first and second electrical insulators comprise a plurality of openings therethrough to allow the center contact and the plurality of outer contacts of a corresponding one of the first and second connectors to pass therethrough and be soldered to and thereby electrically connected to the respective first and second antennas and the ground plane on an opposite side of the ground plane without direct galvanic contact between the upper surfaces of the first and second connectors and the ground plane, wherein the integrally formed tabs are configured to reduce direct galvanic metal-to-metal contact surface and reduce soldering area between the cable braids and the ground plane, and wherein:

the first and second connectors comprise first and second bulkhead connectors each having at least one center contact made of non-ferromagnetic material and that is soldered to and thereby electrically connected to the corresponding first or second antenna and four outer contacts made of non-ferromagnetic material and that are soldered to and thereby electrically connected to the ground plane; and the first and second electrical insulators are positioned between upper surfaces of the respective first and second bulkhead connectors and the ground plane to electrically insulate and reduce galvanic contact area between the upper surfaces of the first and second bulkhead connectors and the ground plane, to thereby reduce passive intermodulation; and the openings of the ground plane and the first and second electrical insulators allow the center contact and the four outer contacts of a corresponding one of the first and second bulkhead connectors to pass therethrough and be soldered to and thereby electrically connected to the respective first and second antennas and the ground plane on an opposite side of the ground plane without direct galvanic contact between the upper surfaces of the first and second bulkhead connectors and the ground plane.

13. The antenna system of claim 12, wherein the integrally formed tabs of the ground plane comprise first and second pairs of tabs stamped from the ground plane and bent at an acute angle relative to the ground plane such that there is no galvanic contact along the bottom of the cable braids to the ground plane and such that an area underneath the bottom of the cable braids is open or hollow due to the stamping and repositioning of ground plane material to make the first and second pairs of tabs.

14. An antenna system operable with low passive intermodulation, the antenna system comprising:

a base;

a ground plane mounted to the base and including integrally formed tabs to which are solderable cable braids;

first and second antennas;

a first isolator disposed between the first and second antennas, the first isolator comprising a vertical wall PCB isolator;

a second isolator extending outwardly from the ground plane and separate from the first isolator;

wherein the ground plane and/or the base includes one or more integrally formed features for holding the first isolator generally perpendicular to the ground plane;

wherein the ground plane, the first and second isolators, and the first and second antennas are made of non-ferromagnetic material;

wherein the integrally formed tabs of the ground plane comprise tabs directly formed from ground plane material that is repositioned at an acute angle relative to the ground plane, whereby there is no galvanic contact along a bottom of the cable braids to the ground plane, and/or whereby an area underneath the bottom of the cable braids is open or hollow due to the repositioning of the ground plane material to make the tabs.

15. The antenna system of claim 14, wherein:

the antenna system is operable within at least a first frequency range from about 698 megahertz to about 960 megahertz and a second frequency range from about 1710 megahertz to about 2700 megahertz;

at least a portion of the first isolator is vertically disposed over and overlaps at least a portion of the second isolator; and the second isolator is co-planar with the ground plane.

16. The antenna system of claim 14, wherein the antenna system does not include any ferromagnetic material or ferromagnetic components, and wherein at least a portion of the first isolator is vertically disposed over and overlaps at least a portion of the second isolator.

17. The antenna system of claim 14, further comprising:

first and second connectors each having at least one center contact soldered to and thereby electrically connected to the corresponding first or second antenna and a plurality of outer contacts soldered to and thereby electrically connected to the ground plane; and first and second electrical insulators positioned between upper surfaces of the respective first and second connectors and the ground plane to electrically insulate and reduce galvanic contact area between the upper surfaces of the first and second connectors and the ground plane, to thereby reduce passive intermodulation;

wherein the ground plane and each of the first and second electrical insulators comprise a plurality of openings therethrough to allow the center contact and the outer contacts of a corresponding one of the first and second connectors to pass therethrough and be soldered to and thereby electrically connected to the respective first and second antennas and the ground plane on an opposite side of the ground plane without direct galvanic contact between the upper surfaces of the first and second connectors and the ground plane.

18. The antenna system of claim 14, wherein the integrally formed tabs of the ground plane includes first and second pairs of tabs to which are soldered the cable braids, the first and second pairs of tabs being stamped from the ground plane and bent at an acute angle relative to the ground plane, whereby the first and second pairs of tabs are configured to reduce direct galvanic metal-to-metal contact surface and reduce soldering area between the cable braids and the ground plane, the area underneath the bottom of the cable braids is open or hollow due to the stamping and repositioning of the ground plane material to make the first and second pairs of tabs, and the cable braids being soldered to the first and second pairs of tabs without using solder along the bottom of the cable braids within the open or hollow area between the ground plane and the bottom of the cable braids.

19. The antenna system of claim 14, wherein the base includes integrally formed features for holding the first isolator generally perpendicular to the ground plane, and wherein the integrally formed features comprise portions protruding outwardly from the base that pass through openings in the ground plane, where the portions cooperate to frictionally retain the first isolator therebetween.

20. An antenna system comprising:

a base;

a ground plane mounted to the base and including integrally formed tabs to which are soldered cable braids;

first and second antennas;

a first vertical wall PCB isolator disposed between the first and second antennas;

a second isolator extending outwardly from the ground plane and co-planar with the ground plane, the second isolator separate from the first vertical wall PCB isolator;

wherein the ground plane and/or the base includes one or more integrally formed features for holding the first vertical wall PCB isolator generally perpendicular to the ground plane such that at least a portion of the first vertical wall PCB isolator is vertically disposed over and overlaps at least a portion of the second isolator; and wherein the integrally formed tabs of the ground plane comprise tabs directly formed from material of the ground plane that is repositioned at an acute angle relative to the ground plane, whereby there is no galvanic contact along a bottom of the cable braids to the ground plane and whereby an area underneath the bottom of the cable braids is open or hollow due to the repositioning of the ground plane material to make the tabs and the cable braids being soldered to the tabs without using solder along the bottom of the cable braids within the open or hollow area between the ground plane and the bottom of the cable braids.

* * * * *